US006192526B1

(12) United States Patent
Nichols-Roy et al.

(10) Patent No.: US 6,192,526 B1
(45) Date of Patent: Feb. 27, 2001

(54) TOP MOUNTED FLUSH VALVE FOR A TOILET TANK

(75) Inventors: David Nichols-Roy, Escondido; Alberto C. Torres, Hemet, both of CA (US)

(73) Assignee: Lavelle Industries, Inc., Burlington, WI (US)

( * ) Notice: Subject to any disclaimer, the term of this patent is extended or adjusted under 35 U.S.C. 154(b) by 0 days.

(21) Appl. No.: 09/412,273

(22) Filed: Oct. 5, 1999

(51) Int. Cl.[7] ..... E03D 1/34
(52) U.S. Cl. ..... 4/378; 285/210; 285/139.2
(58) Field of Search ..... 4/378, 417, 418, 4/420; 285/139.2, 208, 209, 210, 322

(56) References Cited

U.S. PATENT DOCUMENTS

| | | | | |
|---|---|---|---|---|
| 454,922 | * | 6/1891 | Taylor | 4/420 X |
| 485,203 | | 11/1892 | Lloyd | 192/17 R |
| 522,005 | * | 6/1894 | Burke | 285/210 |
| 524,051 | * | 8/1894 | Walker | 285/210 |
| 531,425 | * | 12/1894 | Porteous | 285/210 |
| 686,105 | | 11/1901 | Meyer et al. | 4/279 |
| 1,131,961 | | 3/1915 | Rogers | 4/418 |
| 1,223,534 | | 4/1917 | Toman | 4/393 |
| 1,472,794 | | 11/1923 | Foley | 285/208 X |
| 1,542,645 | | 6/1925 | Saucke | 285/208 X |
| 1,902,229 | | 3/1933 | Goetzelman | 285/208 |
| 1,970,789 | | 8/1934 | Zwermann | 4/417 |
| 1,978,958 | | 10/1934 | Robinson, Sr. | 285/208 |
| 2,087,099 | | 7/1937 | Tilden | 4/378 |
| 2,096,307 | | 10/1937 | Peislak | 4/417 |
| 2,272,197 | | 2/1942 | Groeniger | 4/378 |
| 2,700,774 | | 2/1955 | Smith | 4/417 |
| 2,813,568 | | 11/1957 | Kilmarx, Jr. | 285/208 X |
| 2,892,197 | | 6/1959 | Flieder | 4/393 |
| 3,142,846 | | 8/1964 | Lackenmaier et al. | 4/393 X |
| 3,172,129 | | 3/1965 | Fulton et al. | 4/390 |
| 3,181,899 | | 5/1965 | McKnight, Jr. | 285/208 X |
| 3,267,491 | | 8/1966 | Snyder et al. | 4/417 X |
| 3,322,442 | | 5/1967 | Flachbarth | 285/208 |
| 3,941,904 | | 3/1976 | Hoh et al. | 427/207 |
| 3,988,785 | | 11/1976 | Schoepe et al. | 4/393 X |
| 4,000,526 | | 1/1977 | Biela et al. | 4/379 |
| 4,155,129 | | 5/1979 | Dyer | 4/392 |

(List continued on next page.)

*Primary Examiner*—Robert M. Fetsuga
(74) *Attorney, Agent, or Firm*—Michael H. Jester

(57) ABSTRACT

A top mounted flush valve is provided for installation in a blind drain hole in the bottom wall of a toilet tank of a conventional one-piece gravity operated toilet. The flush valve includes a generally cylindrical valve body sized for insertion through the drain hole from the upperside of the bottom wall of the tank. A seal member on an underside of the valve body provides a watertight seal between the valve body and an upperside of the bottom wall of the tank. A generally cylindrical drive collar is rotatable within a central aperture of the valve body. A generally cylindrical spring nut has a threaded portion engaged with a threaded portion of the drive collar so that the drive collar can be screwed to generate relative movement between the drive collar and the spring nut along a longitudinal axis substantially perpendicular to the bottom wall of the tank. The spring nut has a plurality of resilient fingers that can deflect inwardly to pass partially through the drain hole in the bottom wall of the tank during insertion. The fingers spring outwardly at a predetermined location of the spring nut relative to the bottom wall of the tank in order to provide a locking engagement between the spring nut and the bottom wall of the tank. Rotation of the drive collar in a first predetermined direction relative to the spring nut presses the seal member on the underside of the valve body tightly against the upperside of the bottom wall of the tank. Rotation of the drive collar in a second predetermined direction opposite the first direction releases the seal member.

20 Claims, 20 Drawing Sheets

U.S. PATENT DOCUMENTS

| | | | |
|---|---|---|---|
| 4,189,795 | 2/1980 | Conti et al. | 4/324 |
| 4,234,218 | 11/1980 | Rogers | 285/139.1 X |
| 4,357,720 | 11/1982 | Stähli | 4/378 |
| 4,365,365 | 12/1982 | Antunez | 4/393 |
| 4,433,446 | 2/1984 | Grimstad | 4/378 |
| 4,454,614 | 6/1984 | Gustafsson et al. | 4/378 X |
| 4,471,499 | 9/1984 | Troman et al. | 4/393 |
| 4,757,560 | 7/1988 | Grimstad | 4/417 |
| 4,900,068 | 2/1990 | Law | 285/39.2 |
| 4,922,556 | 5/1990 | Roosa | 4/378 |
| 4,945,580 | 8/1990 | Schmitt et al. | 4/396 X |
| 4,984,312 | 1/1991 | Pickerrell et al. | 4/378 |
| 5,153,948 | 10/1992 | Smith et al. | 4/392 X |
| 5,329,647 | 7/1994 | Condon | 4/378 |
| 5,353,445 | 10/1994 | Denzin | 4/378 |
| 5,692,249 | 12/1997 | Johnson | 4/378 |

* cited by examiner

TOP MOUNTED FLUSH VALVE FOR A TOILET TANK

BACKGROUND OF THE INVENTION

The present invention relates to plumbing fixtures and components, and more particularly, to flush valves for toilet tanks.

A conventional gravity operated flush toilet has several basic components. The china components include a bowl and a water tank mounted on top of a rear portion of the bowl. The bowl and water tank are usually separate pieces joined together, and such an arrangement is hereafter referred to as a two-piece toilet. The plumbing components of a conventional gravity operated flush toilet include a fill valve in the tank that is connected to a water supply line, a flush valve mounted in a hole in the bottom wall of the tank that communicates with the bowl, a flapper valve that normally closes the flush valve, and a lever or push button on the outer wall of the tank that is connected with a chain or other mechanical linkage for momentarily lifting the flapper valve. This allows water stored in the tank to flow rapidly through the flush valve into the bowl to carry waste along with the water through a trap connected to the underside of the bowl and into a waste pipe connected to a sewer line, septic tank or other waste reservoir.

Conventional flush valves for two-piece gravity operated toilets are generally cylindrical and provide a round valve seat for the flapper valve. They are secured in a drain hole in the bottom wall of the toilet tank from underneath the bottom wall. Typically a large nut is screwed over a male threaded lower portion of the cylindrical flush valve body, on the underside of the bottom wall of the tank. See for example U.S. Pat. No. 4,155,128 of Dyer entitled TOILET TANK FLUSH VALVE ASSEMBLY. This is readily accomplished before the tank is mated with the bowl.

Modern gravity operated toilets frequently are made with a one-piece china component in which the bowl and the tank are formed as a one continuous integral piece of porcelain. In such one-piece toilets manual access to the underside of the bottom wall of the tank is severely restricted. This is because a channel from the tank to the toilet bowl and/or a toilet siphon leg is cast directly underneath the toilet tank. Thus the drain hole is a so-called "blind hole". Because there is no ready way to access the underside of the bottom wall of the tank it is very difficult, if not impossible, to thread a large nut over an externally threaded bottom portion of a cylindrical flush valve body.

Various solutions have been proposed for top mounting a flush valve in a blind drain hole in the bottom wall of a toilet tank. A series of screw fasteners can extend through the flush valve body or its throat to engage a spanner or a series of tabs that can be drawn up against the underside of the bottom wall of the tank. This is tedious and such hardware can restrict or diminish flow. Alternatively, U. S. Pat. No. 4,433,466 of Grimstad discloses an arrangement in which the drain hole has a triangular configuration. The flush valve body has three equally spaced radially extending tab-like projections that can be inserted through the irregular shaped drain hole. Once inserted, the flush valve body can be rotated so that the projections engage the underside of the bottom wall of the toilet tank. A resilient seal surrounding the valve body is squeezed between the upperside of the bottom wall of the toilet tank and a flange or shoulder on the flush valve body when the projections are engaged against the underside of the bottom wall of the tank. One drawback of this approach is that the flush valve is not truly locked in position and can be dislodged if inadvertently twisted. Furthermore, homeowners and other non-plumbers my not correctly orient the flush valve after replacing the seal, and leaks can result. In addition, it is not possible to produce a universal top mounted flush valve where one design must be configured for irregular blind drain holes and another design configured for round drain holes.

U.S. Pat. No. 5,692,249 of Johnson discloses another top mounted flush valve for a toilet tank. It includes a draw collar which can be rotated to outwardly collapse a seal barrel portion of a deformable seal member against the underside of the bottom wall of the toilet tank. While this invention has been commercialized with some success, it has several drawbacks. The seal member may harden over time due to the effects of chlorine in the water. This may make it extremely difficult to remove the seal member to allow replacement of the same. Also, the co-molded seal and nut in the commercial version of this invention can break down over time and leakage can result.

SUMMARY OF THE INVENTION

It is therefore the primary object of the present invention to provide an improved top mounted flush valve for a toilet tank having a blind drain hole.

The present invention provides a top mounted flush valve for installation in a blind drain hole in the bottom wall of a toilet tank. The flush valve includes a generally cylindrical valve body sized for insertion through the drain hole from the upperside of the bottom wall of the toilet tank. A seal member on an underside of the valve body provides a watertight seal between the valve body and an upperside of the bottom wall of the tank. A generally cylindrical drive collar is rotatable within a central aperture of the valve body. A generally cylindrical spring nut has a threaded portion engaged with a threaded portion of the drive collar so that the drive collar can be screwed to generate relative movement between the drive collar and the spring nut along a longitudinal axis substantially perpendicular to the bottom wall of the tank. The spring nut has a plurality of fingers that can deflect inwardly to pass partially through the drain hole in the bottom wall of the tank during insertion. The fingers spring outwardly at a predetermined location of the spring nut relative to the bottom wall of the tank in order to provide a locking engagement between the spring nut and the bottom wall of the tank. Rotation of the drive collar in a first predetermined direction relative to the spring nut presses the seal member on the underside of the valve body tightly against the upperside of the bottom wall of the tank. Rotation of the drive collar in a second predetermined direction opposite the first direction releases the seal member.

The present invention also provides a method of mounting a flapper valve seat in a blind drain hole in a bottom wall of a one-piece gravity operated toilet. The first step of the method involves mounting an elastomeric seal member around an underside of a generally cylindrical valve body having an upperside defining an annular flapper valve seat surrounding a central aperture. The next step of the method involves coupling a generally cylindrical spring nut to the valve body. The next step of the method involves partially inserting the spring nut through a blind drain hole in a bottom wall of a toilet tank until a plurality of circumferentially spaced fingers on the spring nut lock the spring nut into position on the bottom wall of the tank at a predetermined location. The final step of the method involves drawing the valve body downwardly relative to the spring nut to squeeze the seal member against an upperside of the bottom wall of the tank to provide a watertight seal between the upperside of the bottom wall and the valve body.

DESCRIPTION OF THE PREFERRED EMBODIMENT

Figure 8:
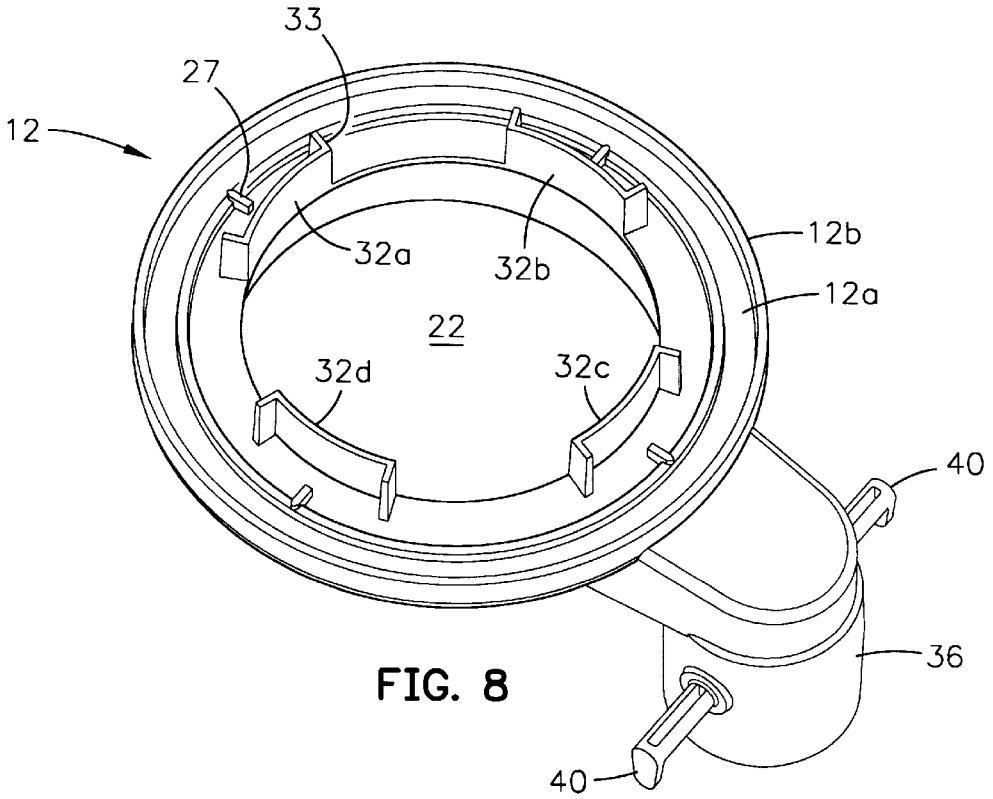
FIG. 8 is an enlarged perspective view of the valve body taken from the underside thereof.
Figure 9:
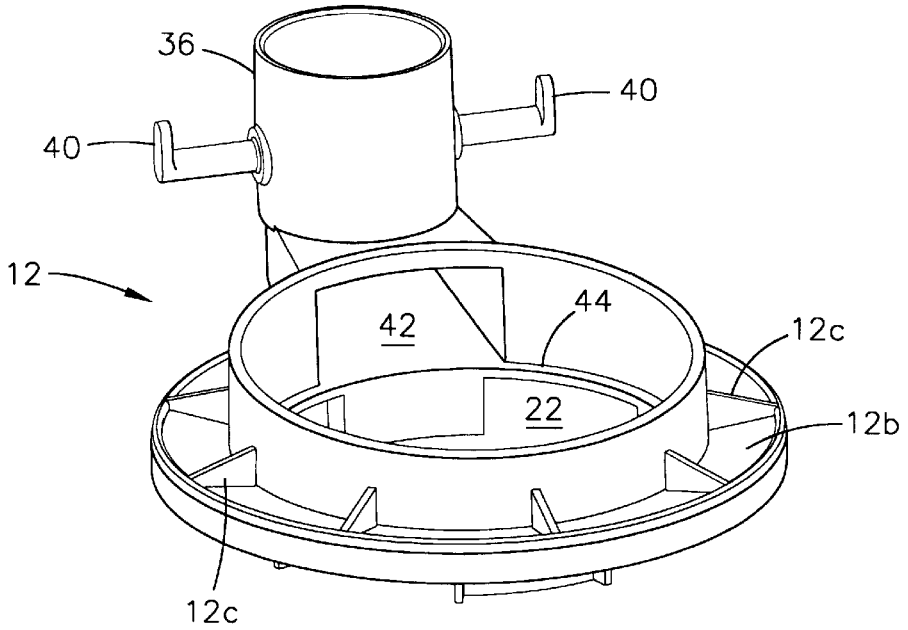
FIG. 9 is an enlarged perspective view of the valve body taken from the upperside thereof.
Figure 10A:
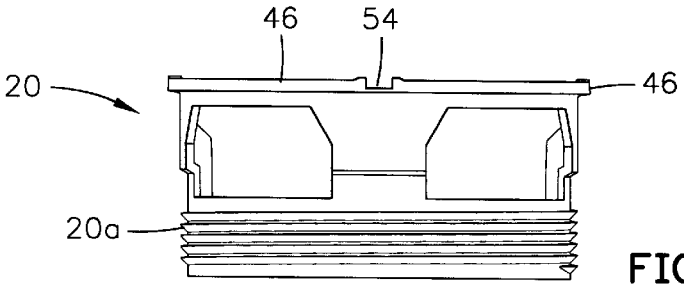
FIG. 10A is an enlarged side elevation view of the drive collar of the flush valve of FIGS. 1A–1F.
Figure 10B:
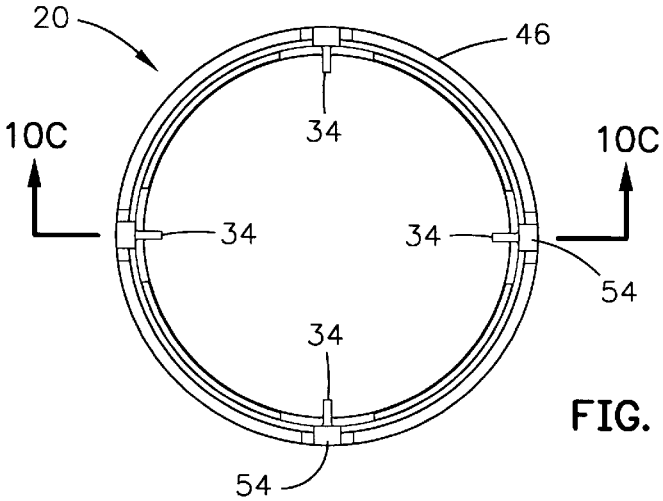
FIG. 10B is an enlarged top plan view of the drive collar.
Figure 10C:
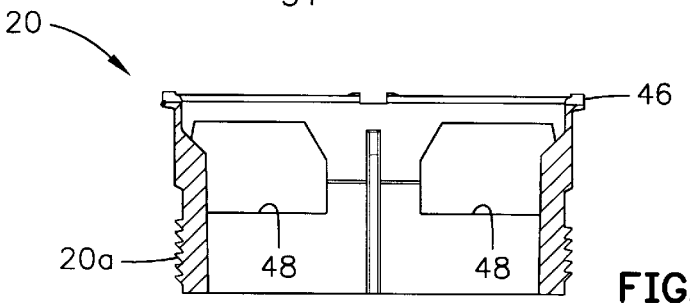
FIG. 10C is an enlarged vertical sectional view of the drive collar taken along line 10C—10C of FIG. 10B.
Figure 16B:
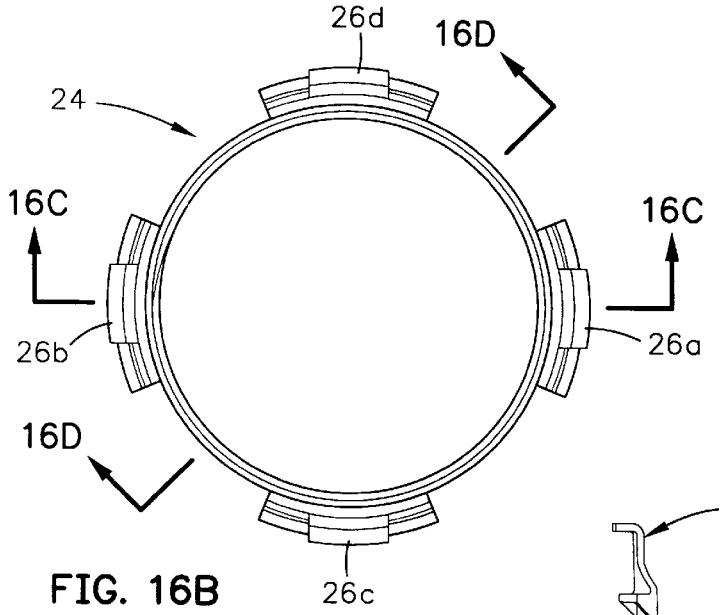
FIG. 16B is an enlarged top plan view of the spring nut.
Figure 16A:
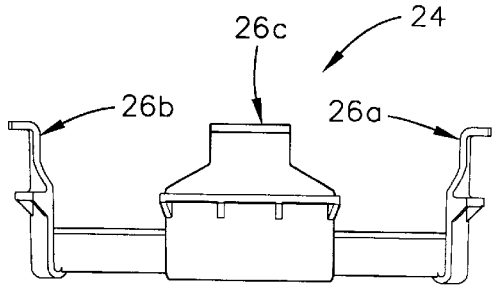
FIG. 16A is an enlarged side elevation view of the spring nut of the flush valve of FIGS. 1A–1F.
Figure 16C:
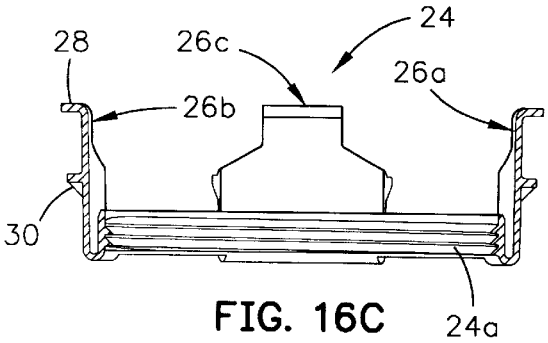
FIG. 16C is an enlarged vertical sectional view of the spring nut taken along line 16C—16C of FIG. 16B.
Figure 16D:
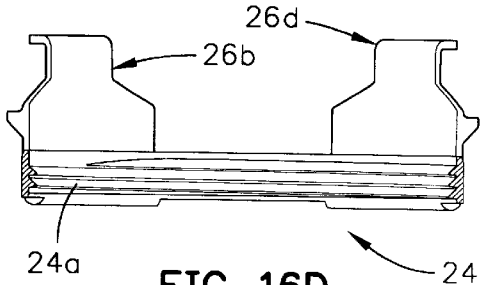
FIG. 16D is an enlarged vertical sectional view of the spring nut taken along line 16D—16D of FIG. 16B.
Figure 16E:
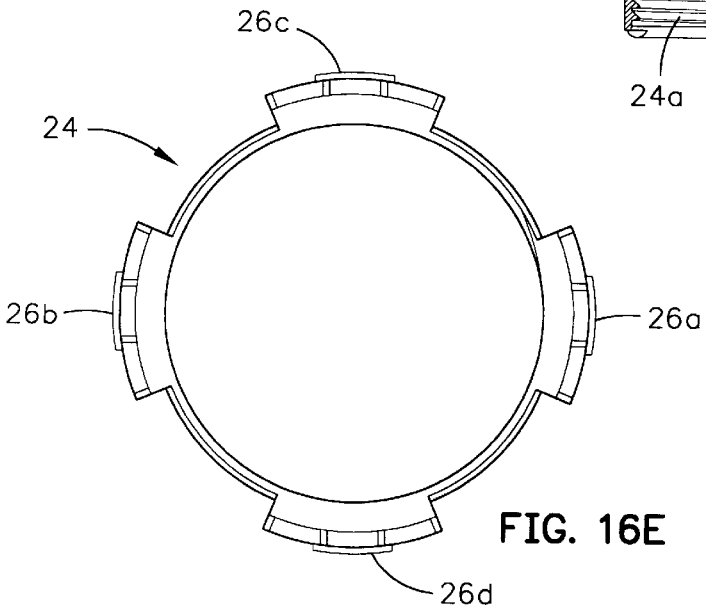
FIG. 16E is an enlarged bottom plan view of the spring nut.
Figure 17:
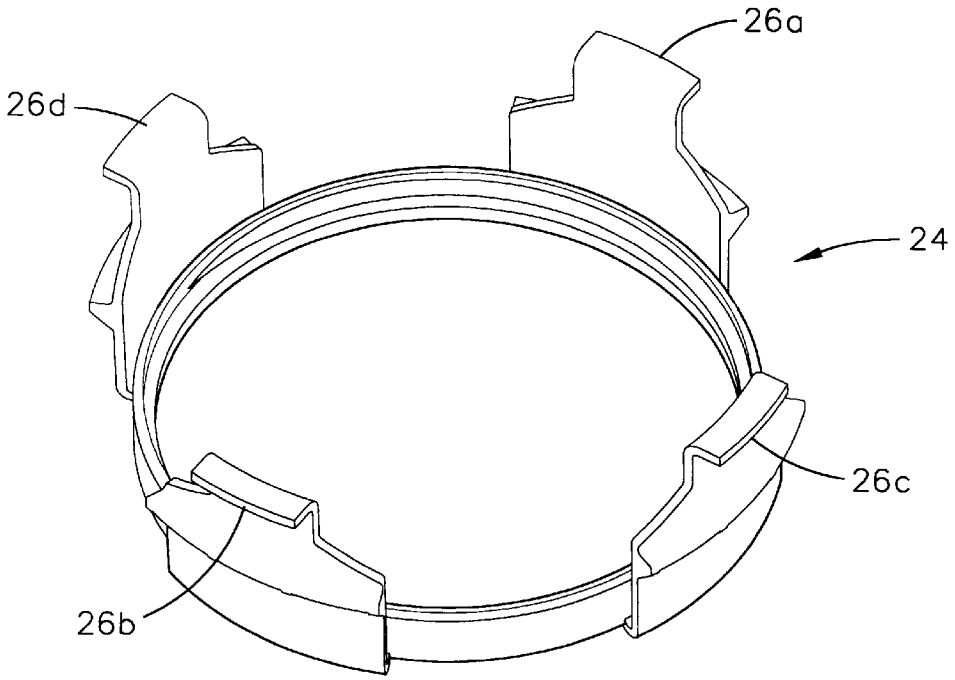
FIG. 17 is a greatly enlarged perspective view of the spring nut taken from the upperside thereof.
Figure 18:
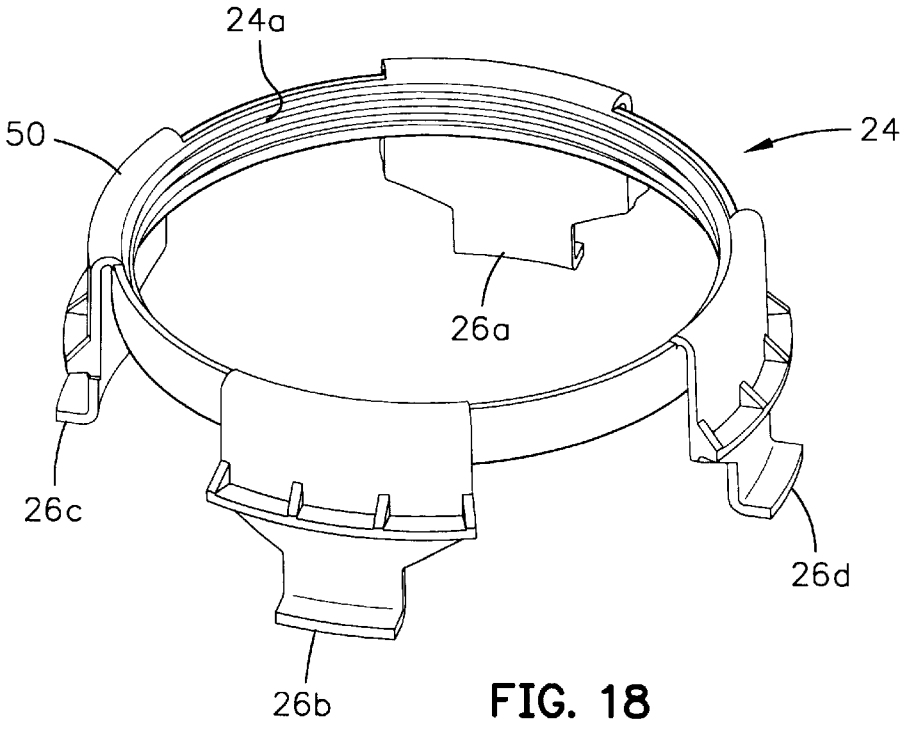
FIG. 18 is a greatly enlarged perspective view of the spring nut taken from the underside thereof.

In accordance with the present invention a flush valve 10 (FIGS. 1A–1F and 2–6) includes a generally cylindrical valve body 12 (FIGS. 7A–7G, 8 and 9) sized for insertion through a blind drain hole 14 (FIGS. 19A–19C) from the upperside of the bottom wall 16 of a toilet tank. A seal member 18 (FIGS. 7B and 13–15) on an underside of the valve body 12 provides a watertight seal between the valve body 12 and an upperside of the bottom wall 16 of the tank. A generally cylindrical drive collar 20 (FIGS. 10A–10D, 11 and 12) is rotatable within a large central aperture 22 (FIGS. 8 and 9) of the valve body 12. The drive collar 20 is concentrically mounted within the central aperture of the valve body 12 for rotation about a vertical central axis of the valve body 12. A generally cylindrical spring nut 24 (FIGS. 16A–16E, 17 and 18) has lower female threaded portion 24*a* (FIG. 16C) engaged with a lower male threaded portion 20*a* (FIG. 10A) of the drive collar 20 so that the drive collar 20 can be screwed to generate relative vertical movement between the drive collar 20 and the spring nut 24. This movement takes place along a longitudinal (vertical) axis substantially perpendicular to the bottom wall 16 of the toilet tank. The male and female threads are complementary and are preferably straight threads.

The flush valve 10 has considerably less vertical height or longitudinal dimension than the flush valve of U.S. Pat. No. 5,692,249 of Johnson. This is advantageous in allowing the flush valve 10 to be accommodated by one-piece toilet designs having limited vertical space or clearance for the flush valve. Our flush valve 10 is thus universal in the sense that it will fit virtually all existing one-piece gravity operated toilets.

Figure 19A:
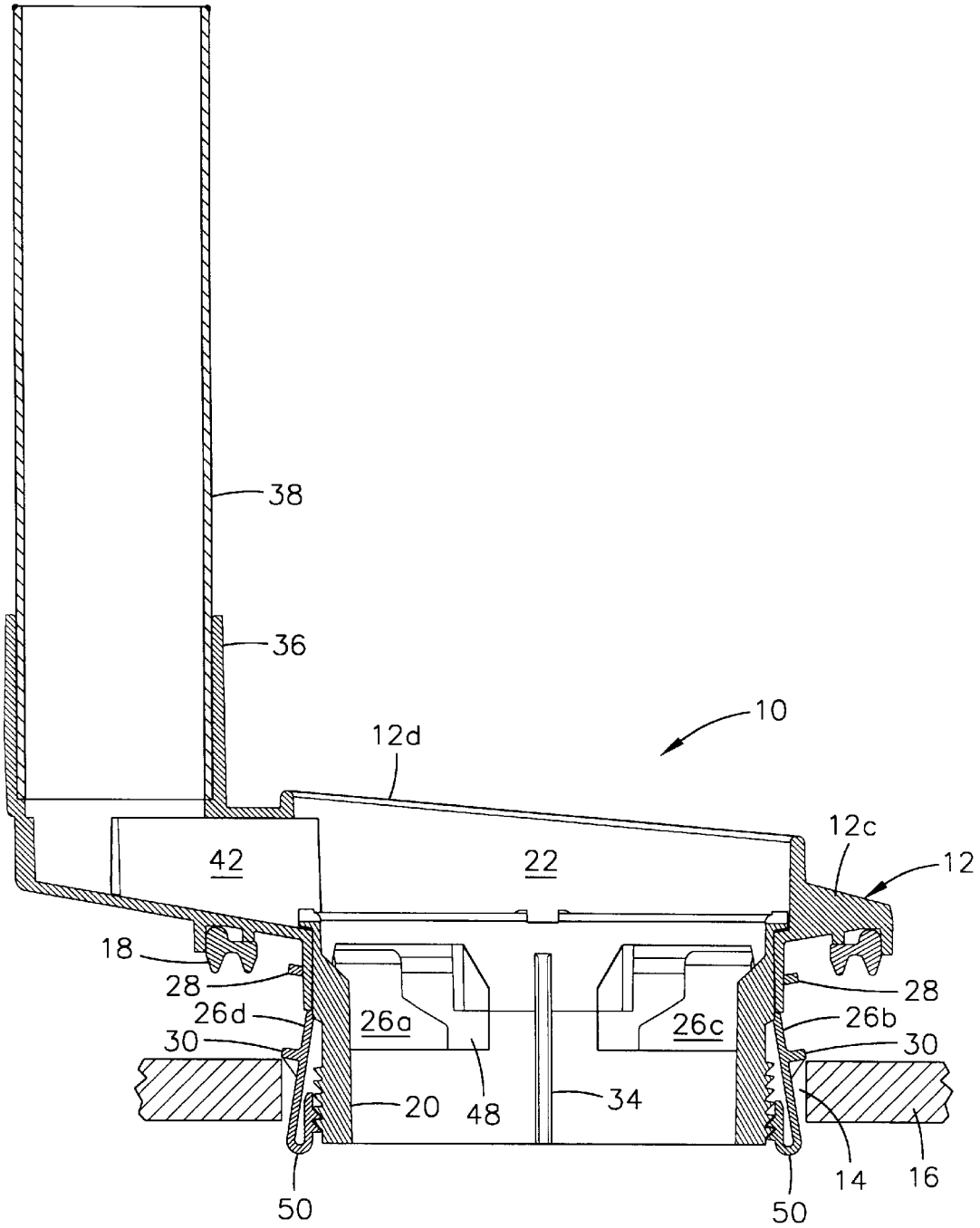
FIGS. 19A, 19B, 19C and 19D are a series of enlarged vertical sectional progressive views illustrating the installation of the flush valve of FIGS. 1A–1F into a drain hole in the bottom wall of a toilet tank.
Figure 19B:
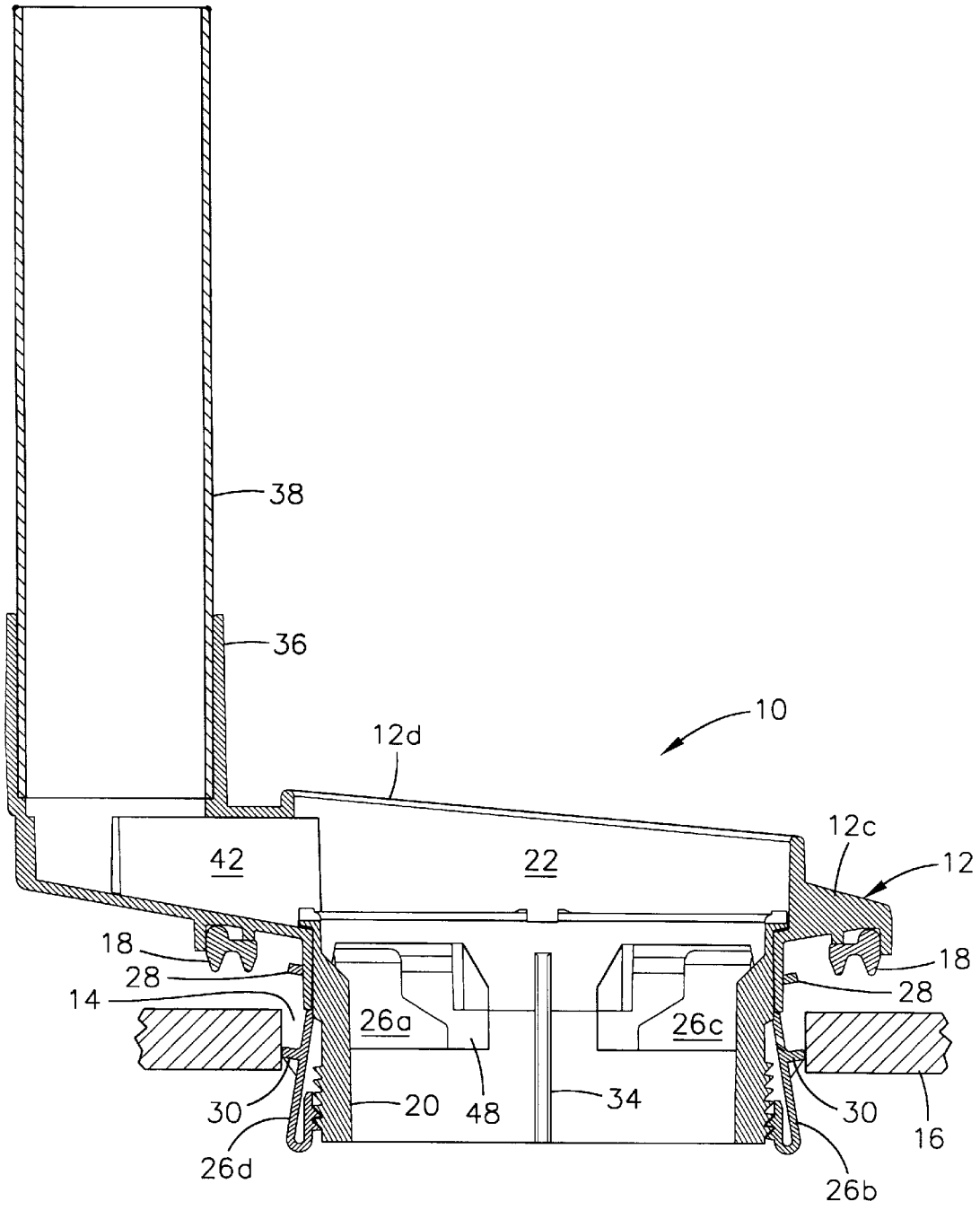
Figure 19C:
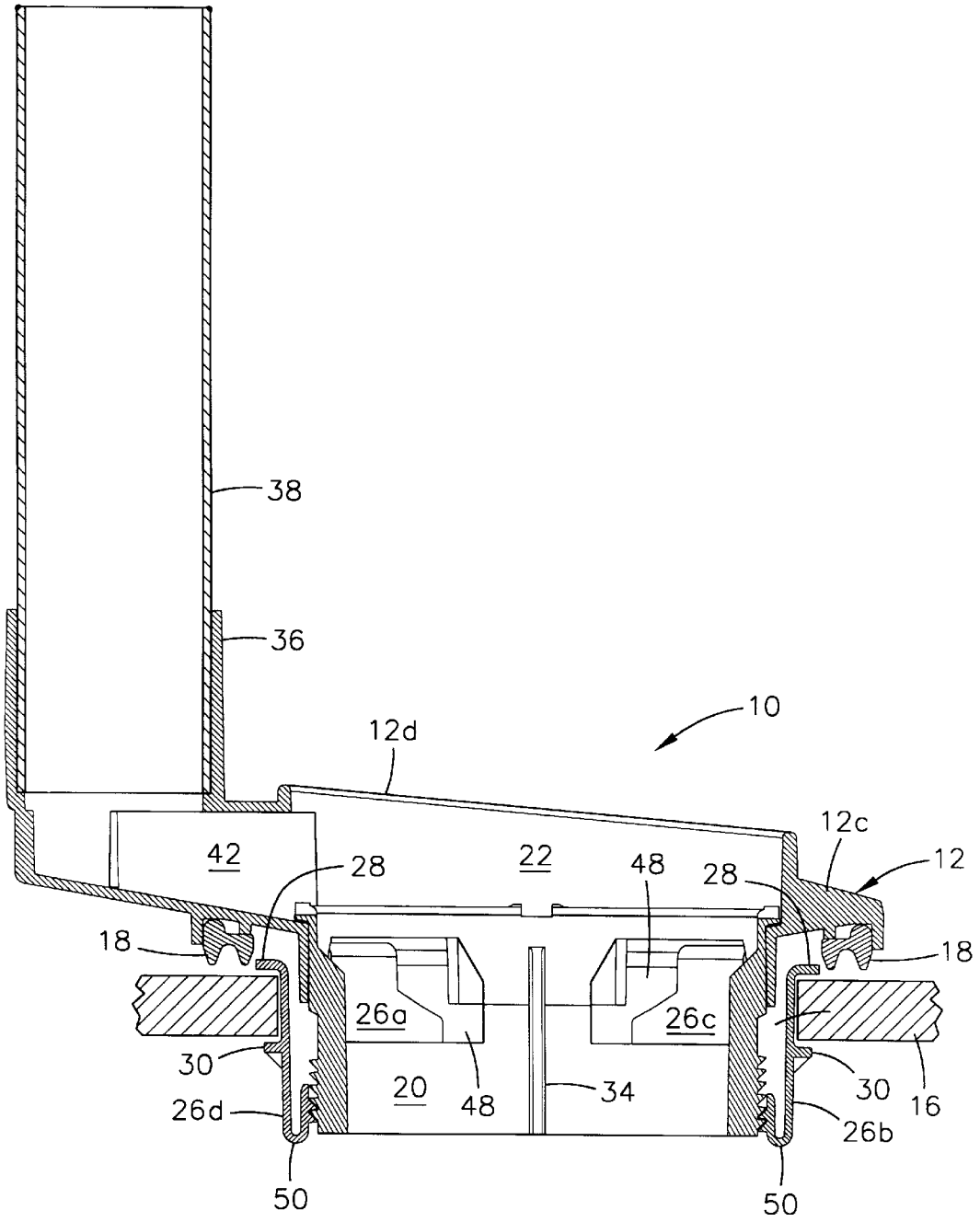
Figure 19D:
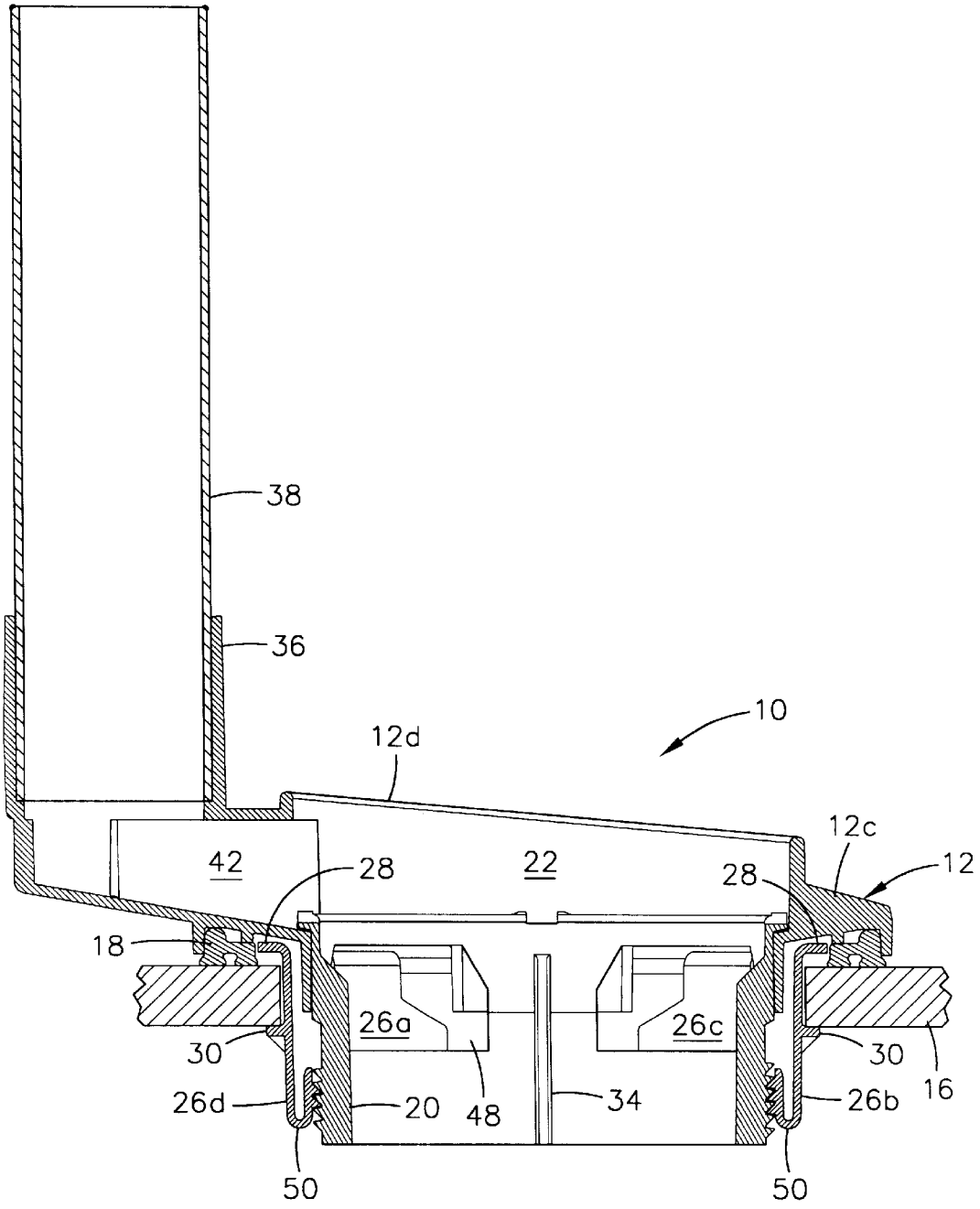
Figure 20A:
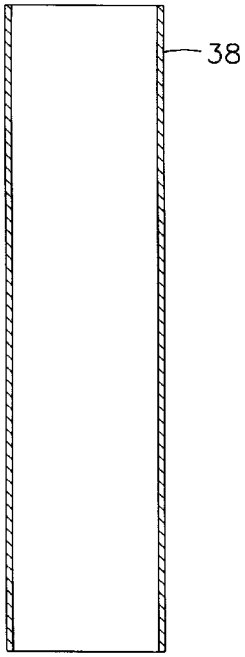
FIG. 20A is a greatly enlarged longitudinal sectional view of the overflow tube of the assembled flush valve of FIGS. 1A–1F.
Figure 20B:
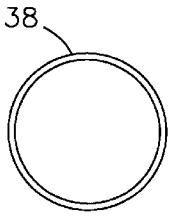
FIG. 20B is a greatly enlarged cross-sectional view of the overflow tube.

The spring nut 24 is formed with four equally circumferentially spaced, axially extending resilient fingers 26*a*, 26*b*, 26*c* and 26*d* (FIGS. 16A–16C) that can deflect inwardly to pass partially through the drain hole 14 in the bottom wall 16 of the tank during downward insertion of the assembled flush valve 10 as illustrated in FIGS. 19A and 19B. The fingers 26*a*, 26*b*, 26*c* and 26*d* spring outwardly at a predetermined location of the spring nut 24 relative to the bottom wall 16 of the toilet tank in order to provide a locking engagement between the spring nut 24 and the bottom wall 16 of the tank as illustrated in FIG. 19C. Rotation of the drive collar 20 in a first predetermined direction (clockwise from above) relative to the spring nut 24 presses the seal member 18 adjacent the underside of the valve body 12 tightly against the upperside of the bottom wall 16 of the tank as illustrated in FIG. 19D. Rotation of the drive collar in a second predetermined direction opposite the first direction (counter-clockwise from above) releases the seal member 18 and permits the flush valve 10 to be removed from the toilet tank.

Figure 7A:
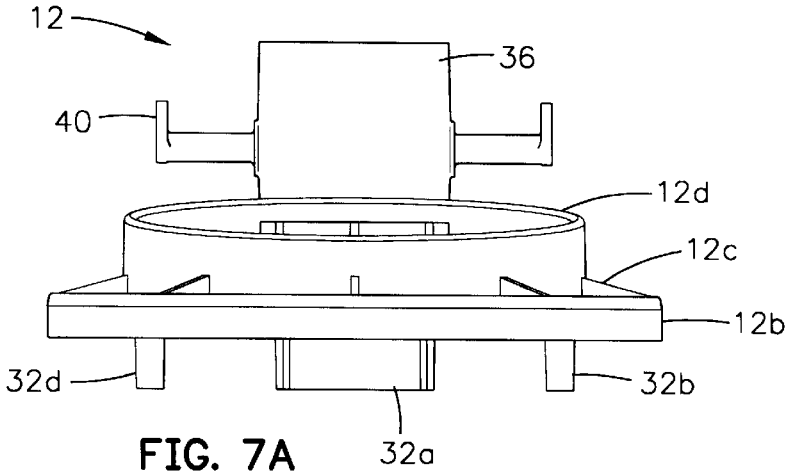
FIG. 7A is a side elevation view of the valve body of the flush valve of FIGS. 1A–1F taken from the right side of FIG. 1A.
Figure 7B:
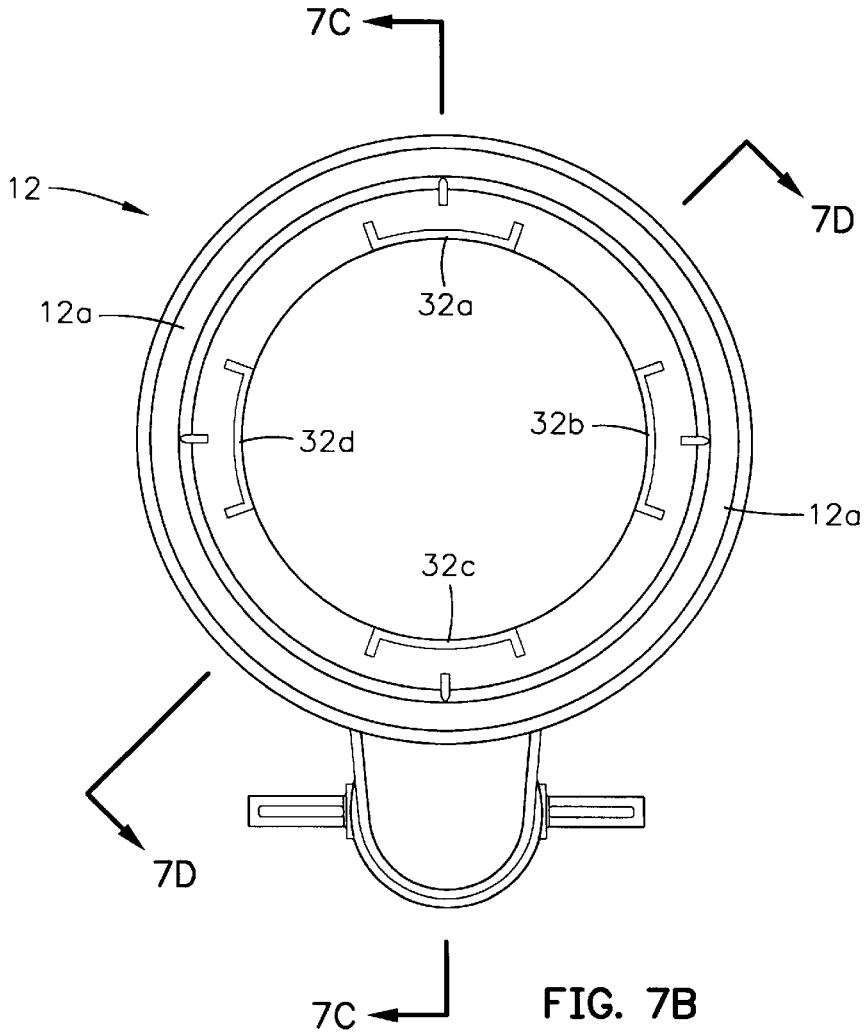
FIG. 7B is a bottom plan view of the valve body.
Figure 7D:
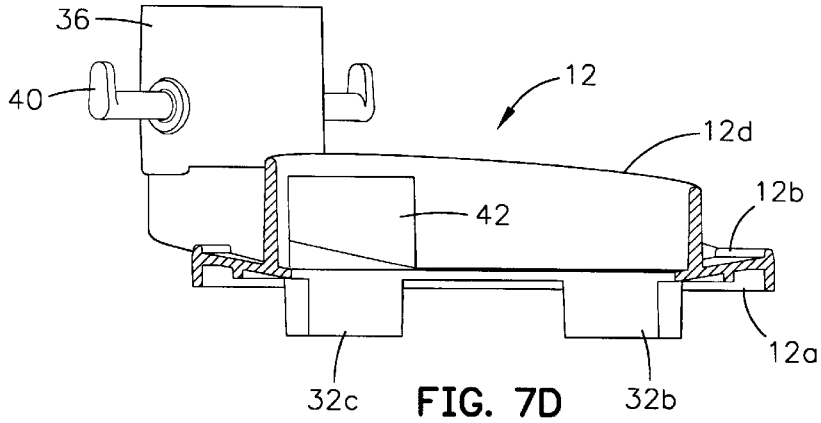
FIG. 7D is a vertical sectional view of the valve body taken along line 7D—7D of FIG. 7B.
Figure 7E:
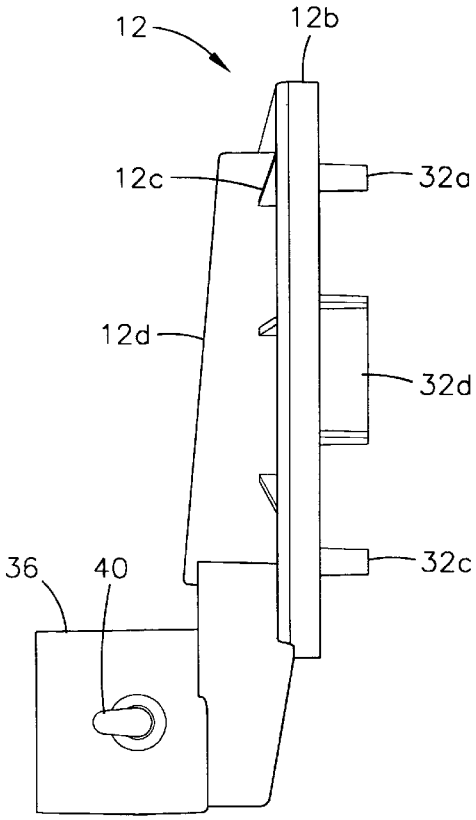
FIG. 7E is a front elevation view of the valve body taken from the bottom of FIG. 1A.
Figure 7C:
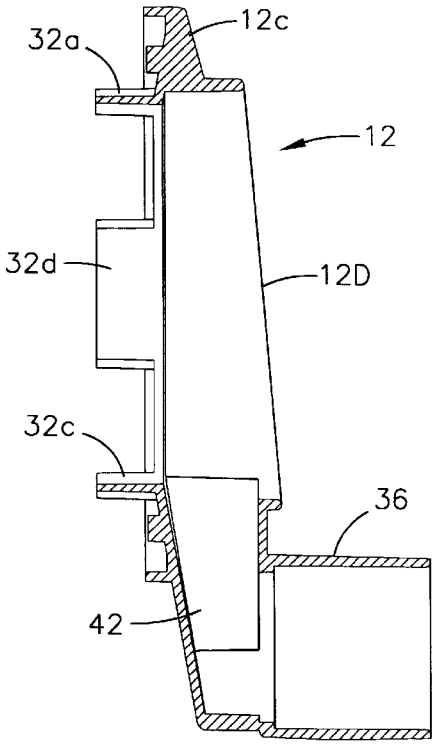
FIG. 7C is a vertical sectional view of the valve body taken along line 7C—7C of FIG. 7B.
Figure 7F:
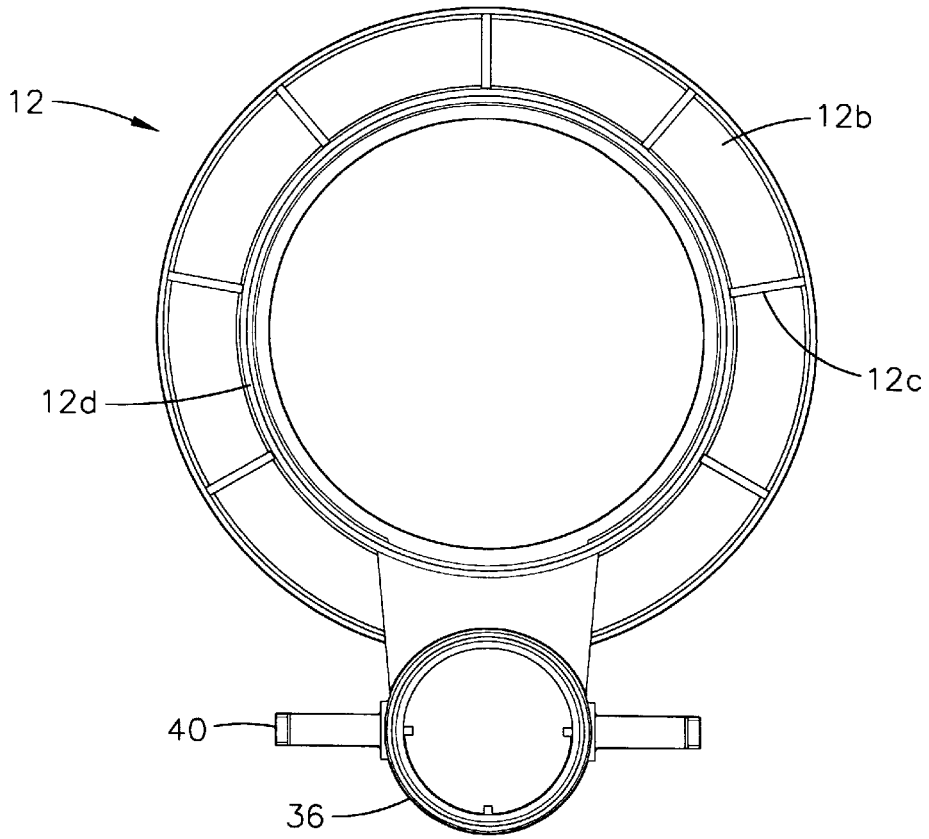
FIG. 7F is a top plan view of valve body.
Figure 7G:
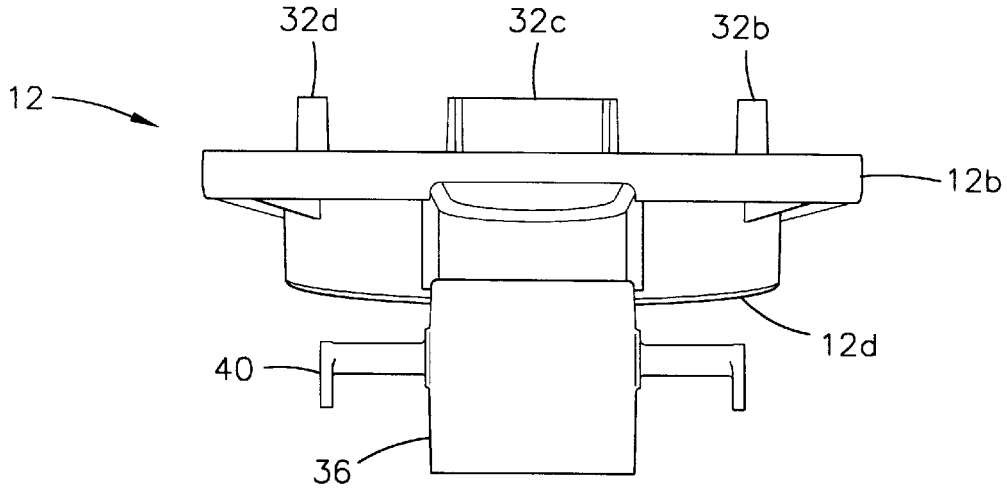
FIG. 7G is an inverted side elevation view of the valve body taken from the left side of FIG. 1A.

The seal member 18 (FIGS. 7B and 13–15) comprises a ring-shaped piece of an elastomeric material which is both resilient and deformable. One suitable material is synthetic rubber. The seal member 18 has a pair of radially spaced ribs 18*a* and 18*b* (FIGS. 2 and 15) that engage the upperside of the bottom wall 16 of the toilet tank to provide a watertight seal when the valve body 12 squeezes down against the seal member 18. The two ribs 18*a* and 18*b* ensure that a watertight seal will be maintained despite any non-uniformities in the upperside of the bottom wall 16. One rib effectively provides a back-up seal to the other rib. The underside of the valve body 12 is formed with a downwardly opening circular groove 12*a* (FIG. 7B) in a radial flange 12*b* for receiving and holding the seal member 18. Radially extending projections 27 (FIG. 8) are formed on the underside of the valve body 12 adjacent the groove 12*a*. The projections 27 press into the seal member 18 to prevent its rotation. The seal member 18 can be replaced should it deteriorate over time due to the introduction of chlorine and other chemicals into the toilet tank. As seen in FIG. 7D flange 12*b* is slightly inclined from horizontal moving in a radially outward direction to improve the sealing action relative to the drain hole 14 in the bottom wall 16 of the toilet tank. A plurality of equally circumferentially spaced ribs 12*c* (FIG. 9) extend between the central annular wall portion of the valve body 12 and the flange 12*b* to provide reinforcement.

The fingers 26*a*, 26*b*, 26*c* and 26*d* (FIGS. 16A–16D) of the spring nut 24 are each formed with a pair of upper and lower, radially outwardly extending flanges 28 and 30 for positioning adjacent an upperside of the bottom wall 16 of the tank and an underside of the bottom wall 16 of the tank, respectively. The lower flanges 30 are formed with beveled shoulders on the lower outer side thereof to facilitate passage through the drain hole 14 in the bottom wall 16 of the tank.

Figure 1A:
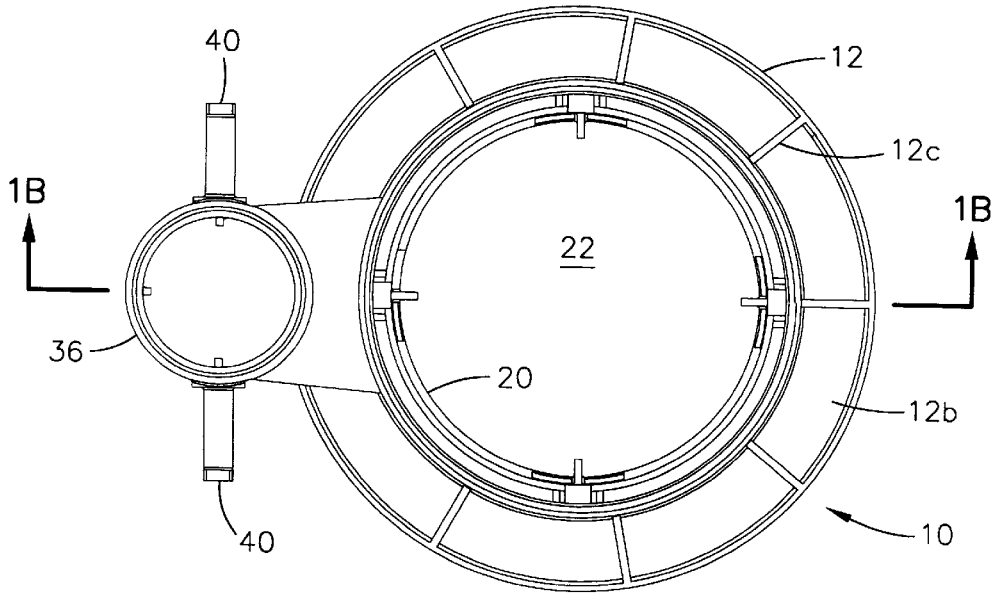
FIG. 1A is a top plan view of a preferred embodiment of a top mounted flush valve in its assembled state, but not installed in a toilet tank.
Figure 1B:
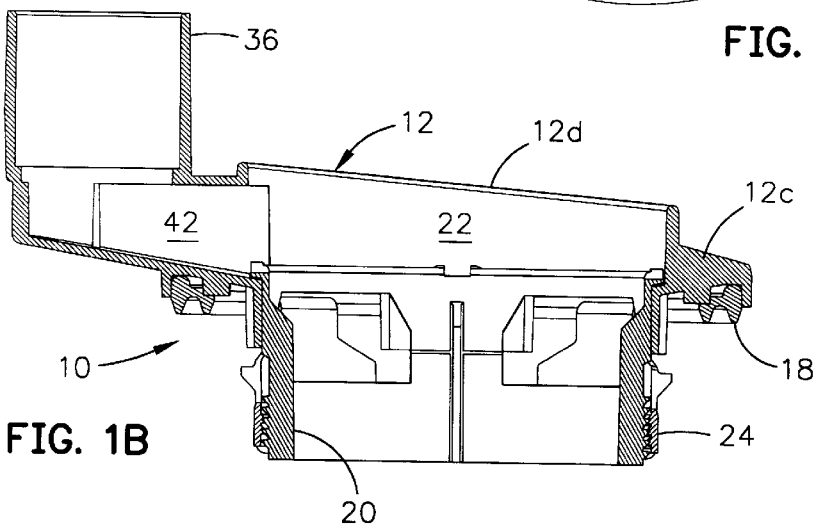
FIG. 1B is a vertical sectional view of the assembled flush valve taken along line 1B—1B of FIG. A.
Figure 1C:
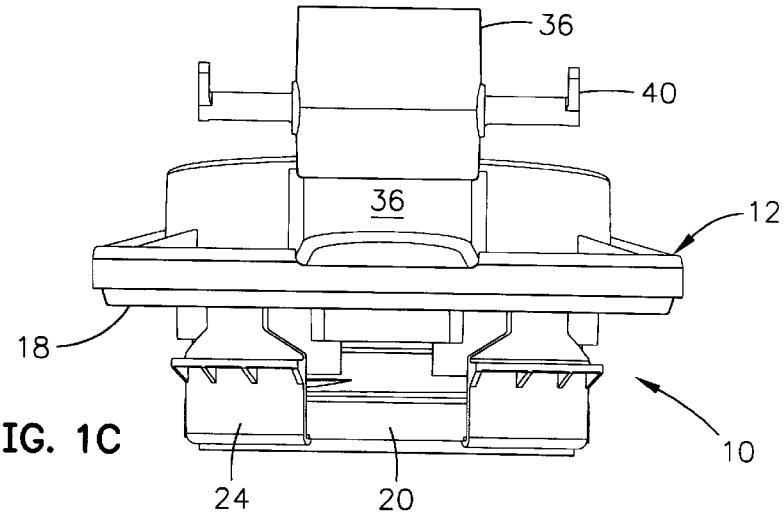
FIG. 1C is a side elevation view of the assembled flush valve taken from the left side of FIG. 1A.
Figure 1D:
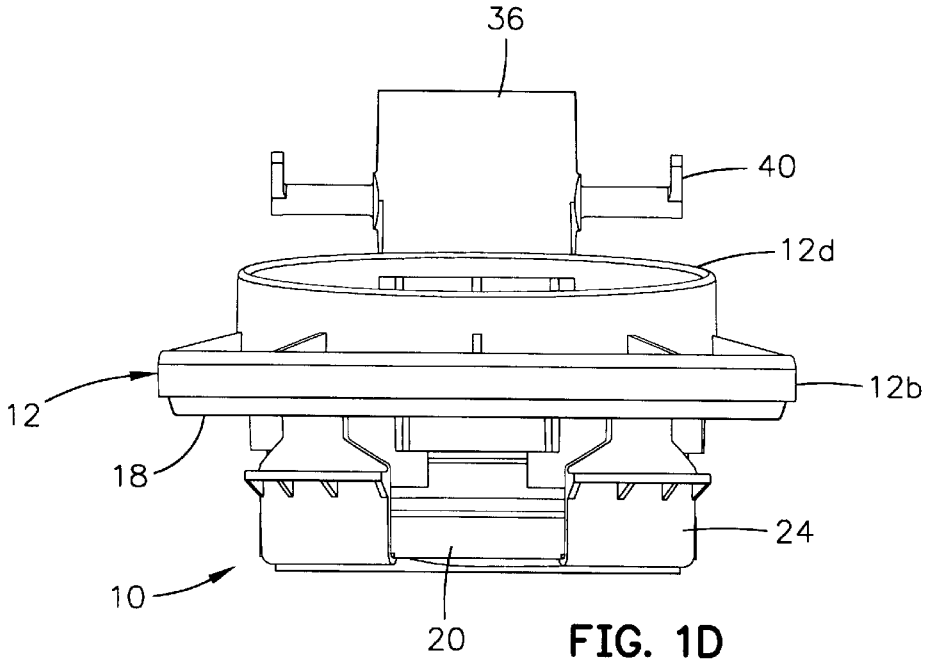
FIG. 1D is a side elevation view of the assembled flush valve taken from the right side of FIG. 1A.
Figure 1E:
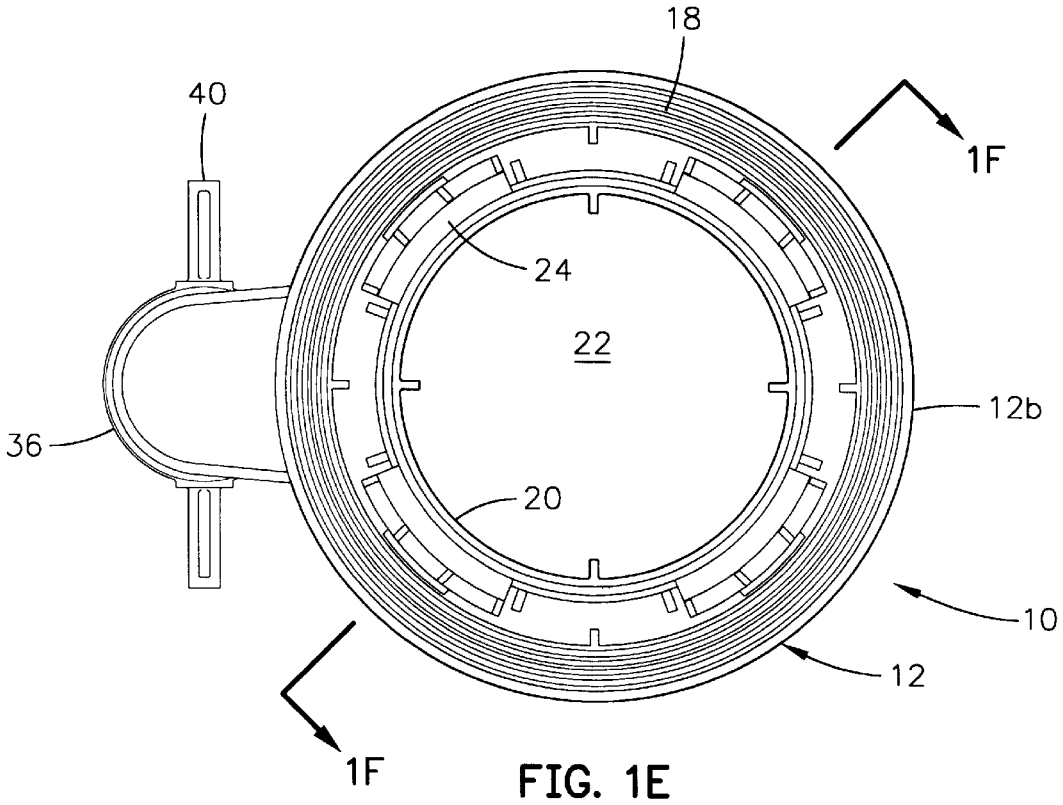
FIG. 1E is a bottom plan view of the assembled flush valve of FIG. 1A.
Figure 1F:
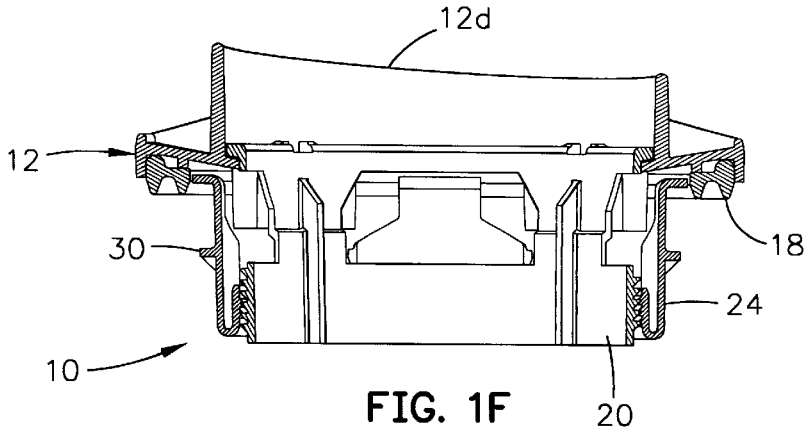
FIG. 1F is a vertical sectional view of the assembled flush valve of taken along line 1F—1F of FIG. 1E.
Figure 3:
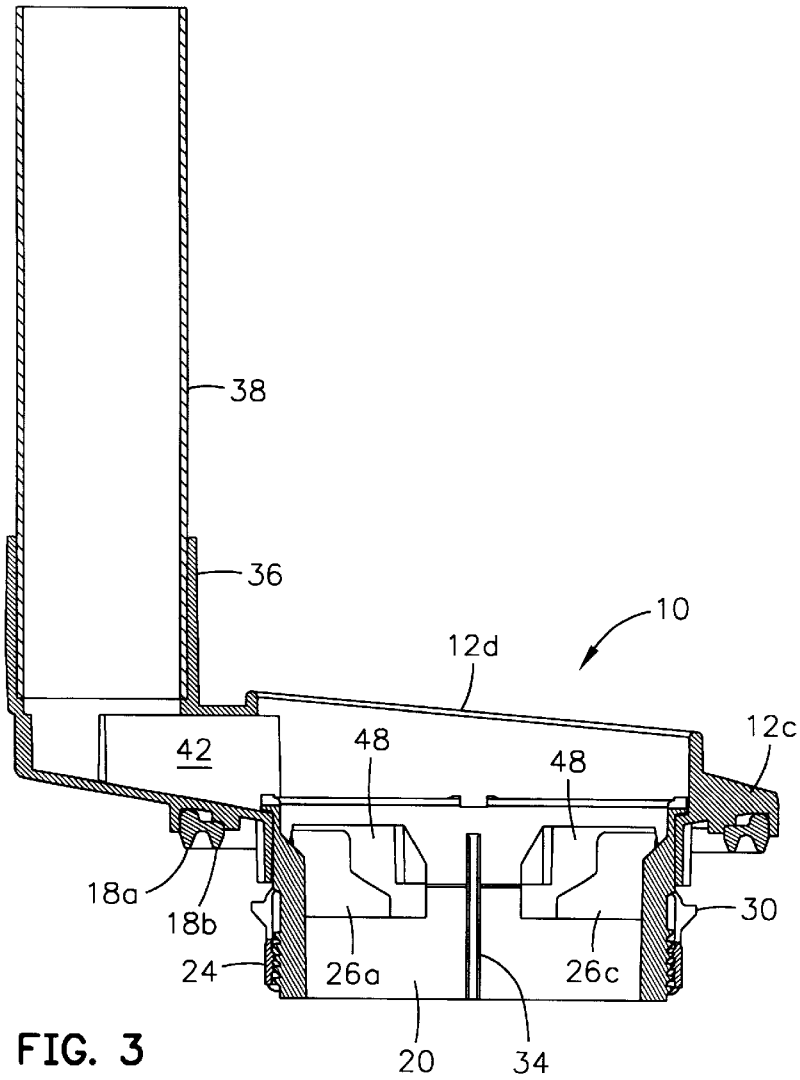
FIG. 3 is a greatly enlarged vertical sectional view of the assembled flush valve similar to FIG. 1B showing more of the overflow tube.
Figure 2:
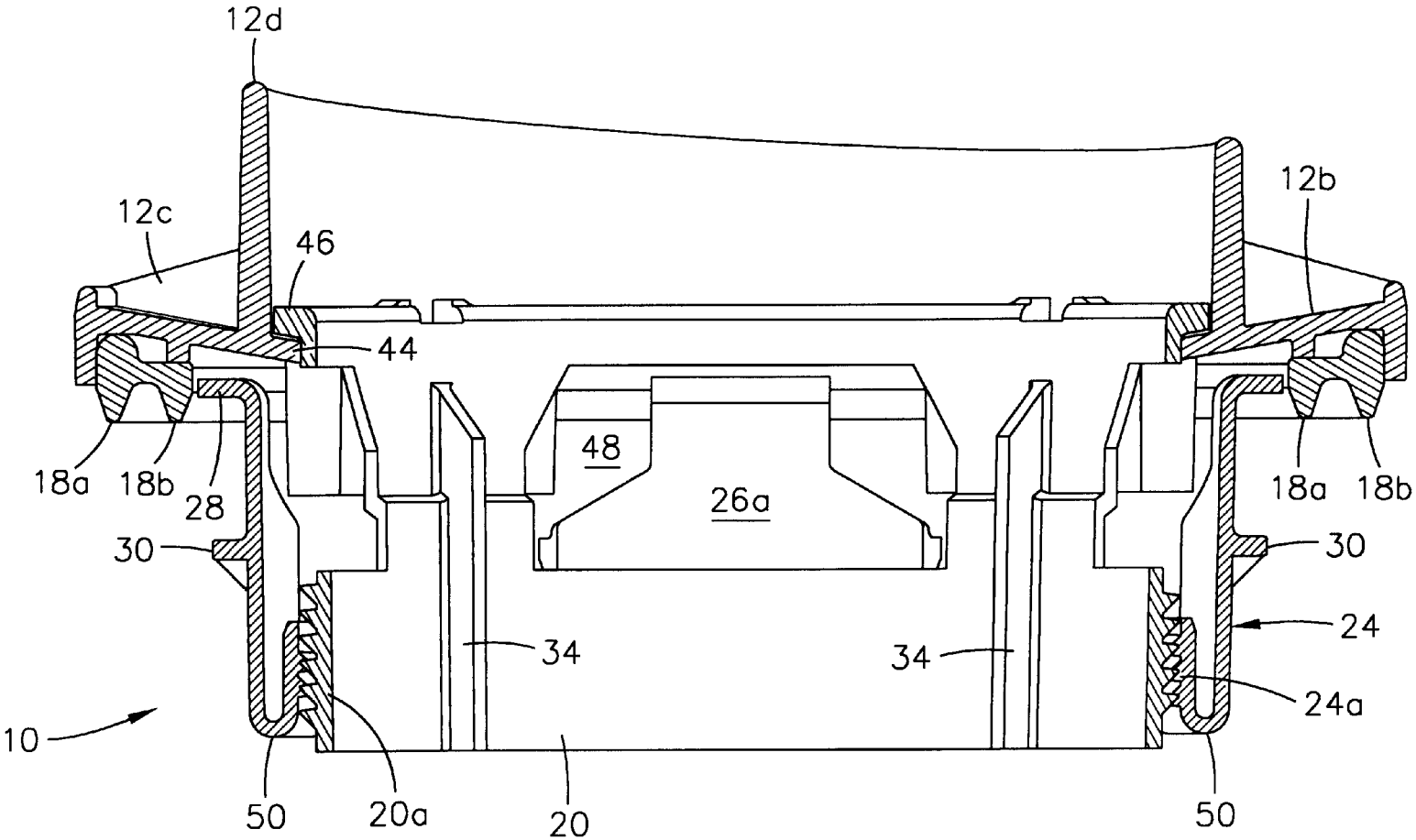
FIG. 2 is a greatly enlarged vertical sectional view of the assembled flush valve similar to FIG. 1F.
Figure 4:
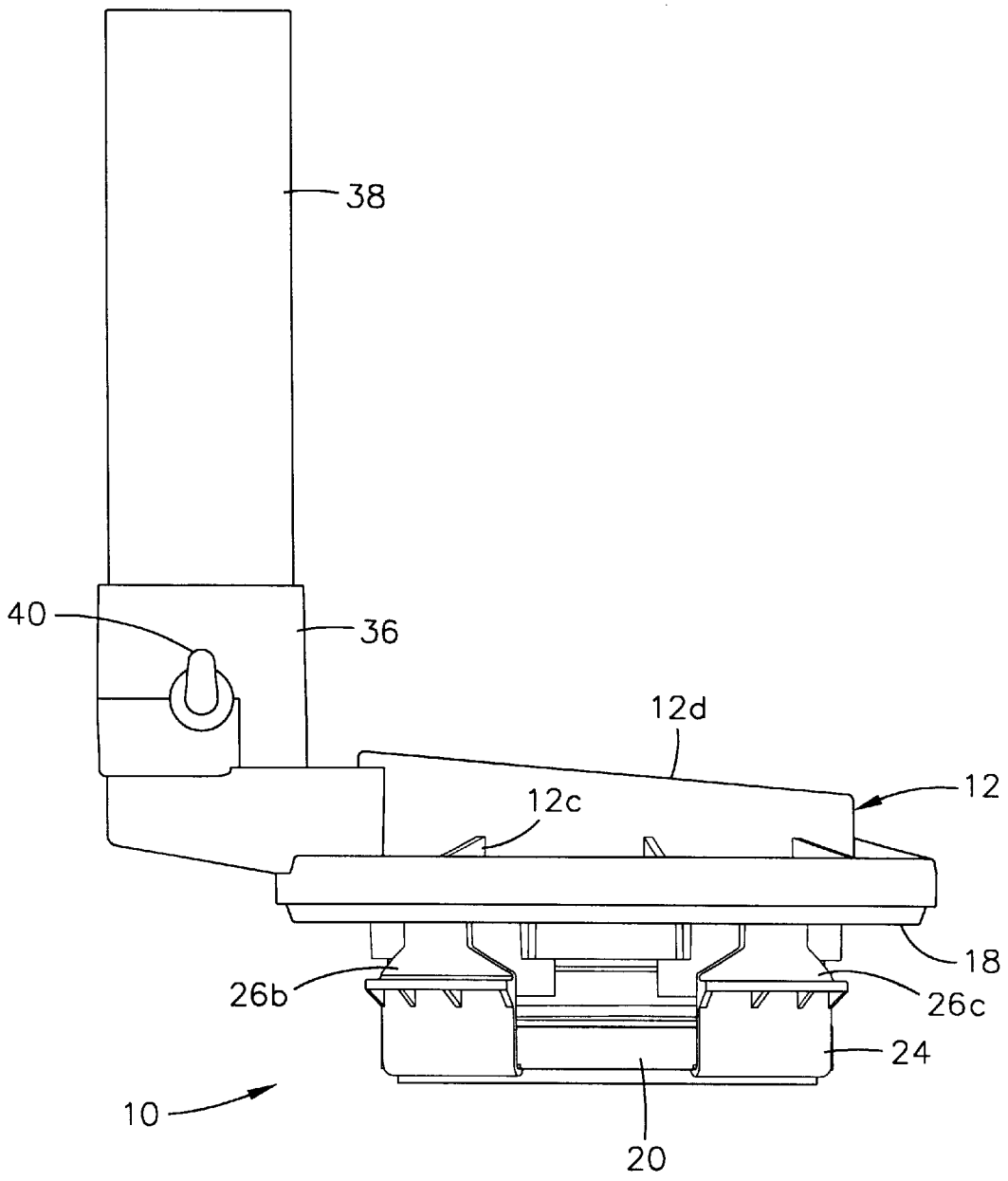
FIG. 4 is a greatly enlarged front elevation view of the assembled flush valve taken from the lower side of FIG. 1A.
Figure 5:
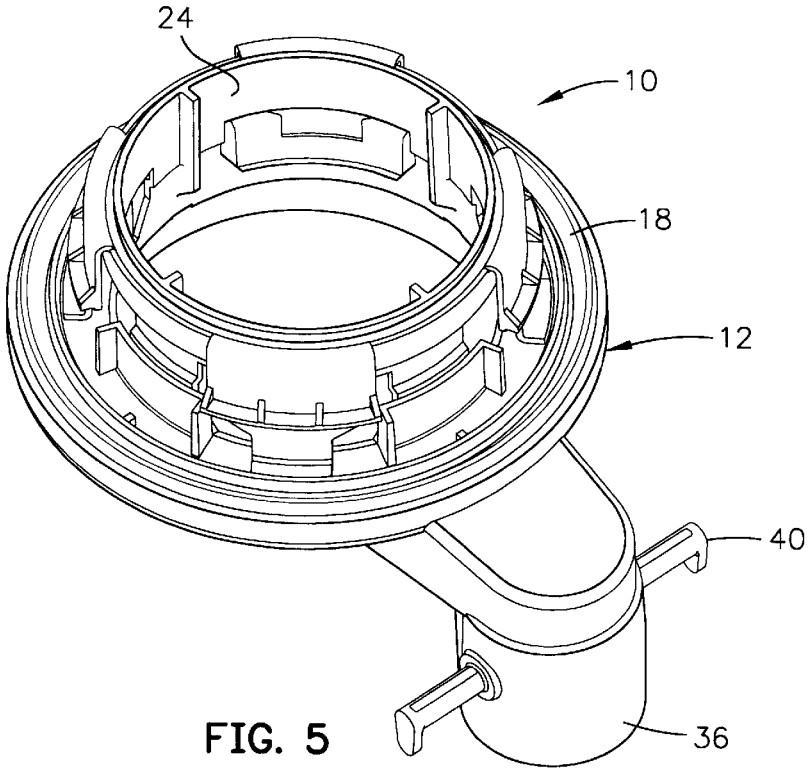
FIG. 5 is an enlarged perspective view of the assembled flush valve taken from the underside of thereof.
Figure 6:
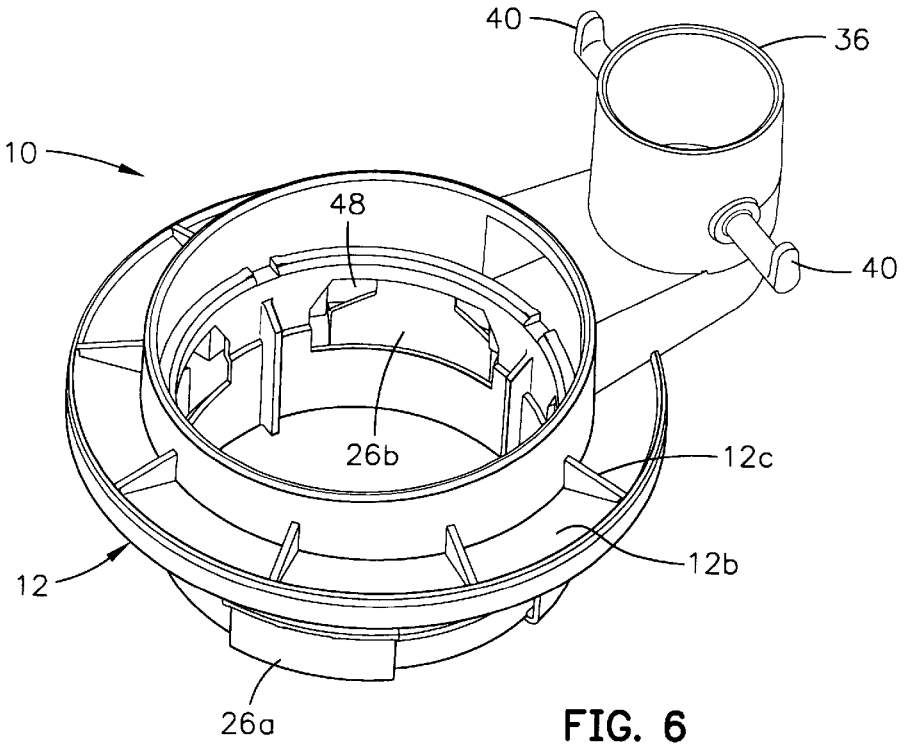
FIG. 6 is an enlarged perspective view of the assembled flush valve taken from the upperside thereof.
Figure 10D:
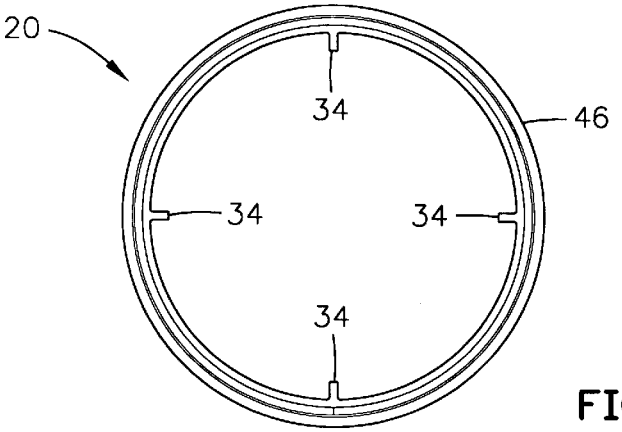
FIG. 10D is an enlarged bottom plan view of the drive collar.
Figure 11:
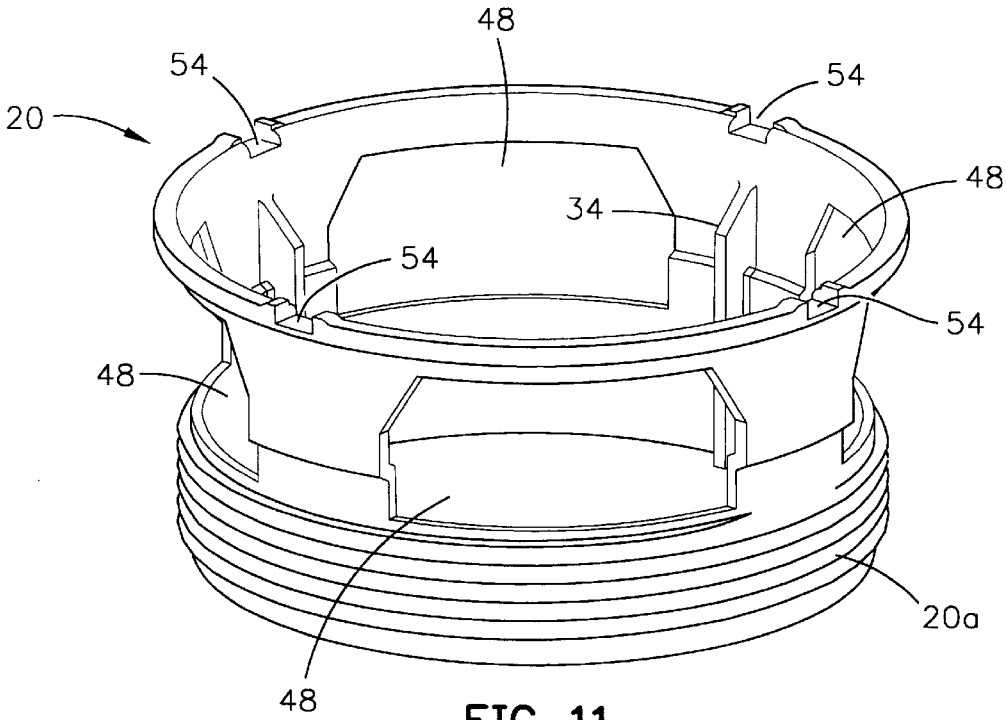
FIG. 11 is a greatly enlarged perspective view of the drive collar taken from the upperside thereof.
Figure 12:
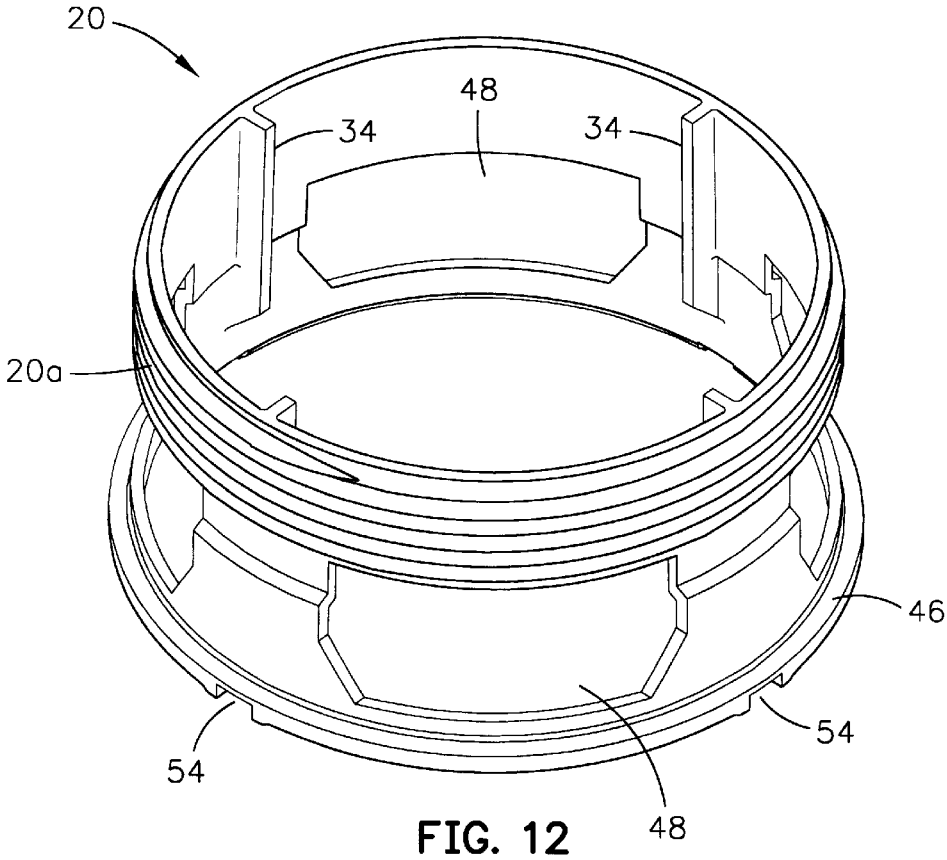
FIG. 12 is a greatly enlarged perspective view of the drive collar taken from the lower side thereof.
Figure 13:
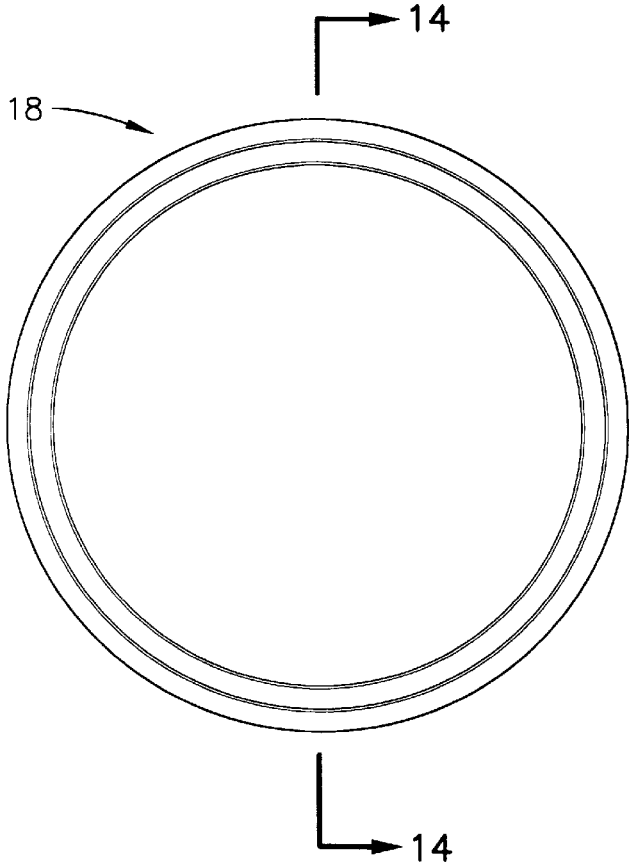
FIG. 13 is a greatly enlarged top plan view of the seal member of the flush valve of FIGS. 1A–1F.
Figure 14:
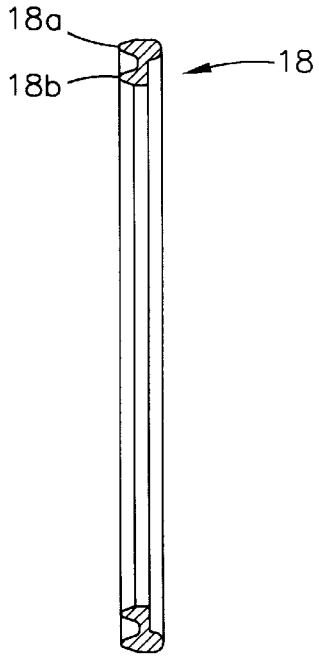
FIG. 14 is a greatly enlarged vertical sectional view of the seal member taken along line 14—14 of FIG. 13.
Figure 15:
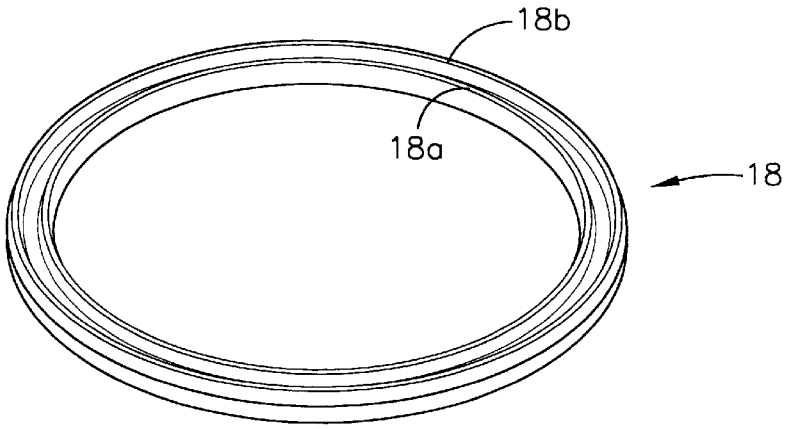
FIG. 15 is a greatly enlarged perspective view of the seal member taken from the underside thereof.

The valve body 12 includes means for preventing rotation of the spring nut 24 relative to the valve body 12 while the drive collar 20 is rotated in the first direction (clockwise) so that the valve body 12 is pulled downwardly against the bottom wall 16 of the toilet tank. Specifically, four equally circumferentially spaced, downwardly extending annular wall sections 32*a*, 32*b*, 32*c* and 32*d* (FIG. 7B) are received between the fingers 26*a*, 26*b*, 26*c* and 26*d* of the spring nut 24. Radially outwardly extending flanges 33 (FIG. 8) on each side of the annular wall sections 32*a*, 32*b*, 32*c* and 32*d*, prevent the spring nut 24 from rotating relative to the valve body 12. This ensures that clockwise rotation of the drive collar 20 will draw the valve body 12 downwardly when the drive collar 20 is rotated in the clockwise direction. This locks the spring nut to the bottom wall 16 of the toilet tank and squeezes the seal member 18 between the flange 12*b* of the valve body 12 and the bottom wall 16 to provide a watertight seal. The drive collar 20 is provided with four equally circumferentially spaced, radially inwardly extending fins 34 (FIGS. 2 and 10D). The fins 34 extend vertically and provide gripping surfaces for a spanner tool 52 (FIGS. 21A, 21B and 21C) that can be inserted into the central bore of the drive collar 20 for rotating it to tighten or loosen the spring nut 24. When the drive collar 20 has been fully rotated, the valve body 12 squeezes the seal member 18 downwardly against the upperside of the bottom wall 16 of the toilet tank, deforming the same as illustrated in FIG. 19D. This provides a watertight seal to prevent water from escaping from the tank except via the central aperture 22 of the flush valve 10.

The valve body 12 has an upperside that defines an annular flapper valve seat 12*d* (FIG. 2). The flapper valve seat 12*d* is slightly inclined from horizontal and the edge portion of the valve body 12 defining the flapper valve seat 12*d* is rounded. The valve body 12 is also formed with a generally cylindrical socket 36 (FIG. 3) for snugly receiving the lower end of a cylindrical overflow tube 38. A pair of L-shaped arms 40 (FIG. 6) extend horizontally on opposite sides of the socket 36 for receiving and holding a pair of arms of a conventional flapper valve (not illustrated). The flapper valve can pivot to open and close the central aperture 22 in the valve body 12. One suitable flapper valve for use with the flush valve 10 of the present invention is disclosed in U.S. Pat. No. 5,153,948 of Smith et al. granted Oct. 13, 1992 and entitled WATER SAVER FOR FLUSH TOILET, the entire disclosure of which is hereby incorporated by reference. In this flapper valve design, an adjustable height float is positioned on a strap connected to the flapper valve to provide buoyancy thereto as long as the float is below the water level in the toilet tank. As an alternative, a flapper valve with a counterbalance in the form of a thin planar member that sticks to the surface of the water in the tank via surface tension during drainage may also be used.

The valve body 12 is formed with a passage 42 (FIG. 3) connecting the socket 36 to the central aperture 22. Water entering the upper end of the overflow tube 38 can flow through the drain hole 14 while the flapper valve is in its closed position sealing the central aperture 22.

The valve body 12 is formed with a shoulder 44 (FIG. 9) adjacent the central aperture 22 that cooperates with a radially outwardly extending flange 46 (FIG. 10A) on the drive collar 20. The shoulder 44 and flange 46 cooperate to limit the downward movement of the drive collar 20 inside the valve body 12. This prevents the drive collar 20 from passing all the way through the central aperture 22 and allows rotation of the drive collar 20 to pull the valve body 12 downwardly. The drive collar 20 is formed with four equally circumferentially spaced openings 48 (FIG. 10C) in its annular wall. These provide additional water flow paths. The openings 48 are shaped and sized to permit the upper ends of the fingers 26*a*, 26*b*, 26*c* and 26*d* of the spring nut 24 to deflect into the same, as best seen in FIG. 19A. This provides sufficient clearance or radial inward movement of the lower flanges 30 of the fingers of the spring nut 24 to allow them to pass through the drain hole 14 in the bottom wall 16 of the toilet tank as illustrated in FIGS. 19A and 19B. The fingers 26*a*, 26*b*, 26*c* and 26*d* each have a hook-shaped configuration including a segment 50 (FIG. 19A) that curves back on itself to permit optimum deflection and spring back of the outer (upper) ends of the fingers.

In order to install the flush valve 10 it is first necessary to align the drive collar 20 so that the openings 48 are aligned with the fingers 26*a*, 26*b*, 26*c* and 26*d*. Then the valve 10 may be pushed downwardly through the drain hole 14 and the upper ends of the fingers 26*a*, 26*b*, 26*c* and 26*d* will deflect into the openings 48 to allow the lower flanges 30 to pass through the hole 14 as shown in FIGS. 19A and 19B. Thereafter, the drive collar 20 may be rotated to pull the valve body 10 downwardly against the seal member 18 to push the same against the upperside of the bottom wall 16 of the toilet tank. The drive collar 20 is preferably aligned with the spring nut 24 at the factory before shipment to toilet manufacturers, wholesalers and retailers.

Figure 21B:
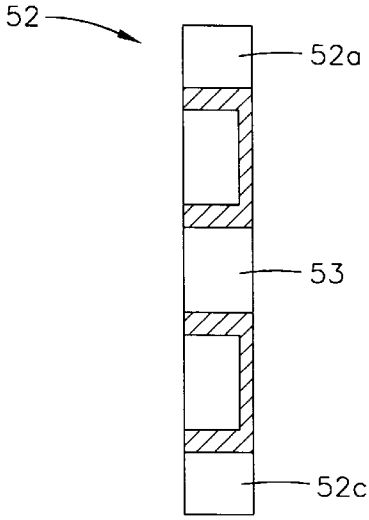
FIG. 21B is a sectional view of the tool of FIG. 21A taken along line 21B—21B of FIG. 21A.
Figure 21A:
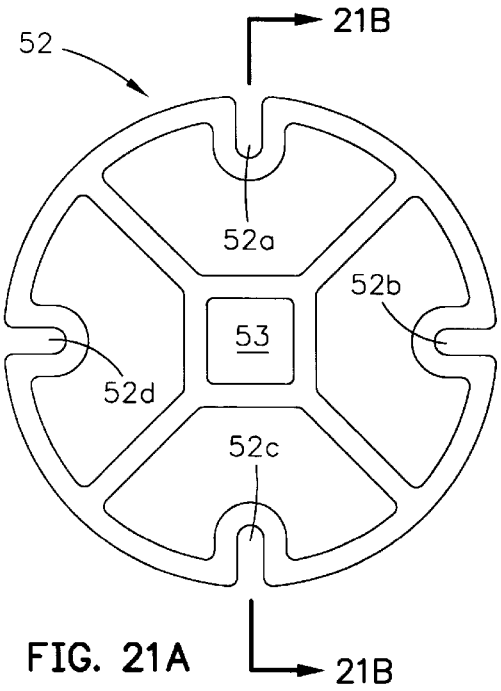
FIG. 21 A is a bottom plan view of a tool that may be inserted into the central aperture of the flush valve of FIGS. 1A–1F to rotate its drive collar.
FIG. 21C is a top plan view of the tool of FIG. 21A.
Figure 21C:
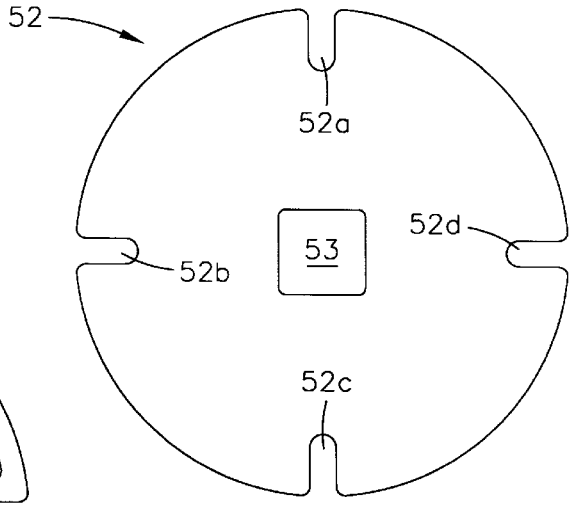

FIGS. 21A–21C illustrate details of the disk-shaped tool 52 that may be inserted into the drive collar 20 to engage an opposite pair of the fins 34 (FIG. 10D) on the inner annular wall of the drive collar 20. The fins 34 are received in corresponding outwardly opening, radially extending slots 52*a*, 52*b*, 52*c* and 52*d* formed at equally circumferentially spaced locations in the periphery of the body portion of the tool 52. The tool 52 may be twisted by inserting a square shaft (not illustrated) into a central square hole 53 in the tool 52 and spinning the same to tighten or loosen the spring nut 24. The upper edge of the drive collar 20 is also formed with four equally circumferentially spaced slots 54 (FIGS. 10A and 10B) to enable a person to insert the tip of a screwdriver or other tool for twisting the drive collar 20 to loosen the spring nut 24.

Preferably the various parts of the flush valve 10 are injection molded using a suitable plastic such as ABS (Trademark) plastic or glass filled polypropylene. A wide variety of other low cost, durable materials suitable for injection molding could also be utilized.

The invention also provides a method of mounting a flush valve 10 including a flapper valve seat 12*d* in a blind drain hole 14 in a bottom wall 16 of a one-piece gravity operated toilet. The first step of the method involves mounting an elastomeric seal member 18 around an underside of a generally cylindrical valve body 12 having an upperside defining the annular flapper valve seat 12*d* surrounding a central aperture 22. The next step of the method involves coupling a generally cylindrical spring nut 24 to the valve body 12. The next step of the method involves partially inserting the spring nut 24 through the blind drain hole 14 in the bottom wall 16 of a toilet tank until a plurality of circumferentially spaced fingers 26*a*, 26*b*, 26*c* and 26*d* on the spring nut 24 lock the spring nut 24 into position on the bottom wall 16 of the tank at a predetermined location. The final step of the method involves drawing the valve body 12 downwardly relative to the spring nut 24 in order to squeeze the seal member 18 against the upperside of the bottom wall 16 of the tank to provide a watertight seal between the upperside of the bottom wall 16 and the valve body 12. While not necessary to the method, it is preferable that the fingers 26*a*, 26*b*, 26*c* and 26*d* of the spring nut 24 are resilient and flex radially inwardly to partially pass through the drain hole 14 and spring back outwardly to lock the spring nut 24 into position on the bottom wall 16 of the toilet tank at the predetermined location. Also, it is preferable in the method that the spring nut 24 is coupled to the valve body 12 with a generally cylindrical drive collar 20 mounted concentrically within the central aperture 22 of the valve body 12 and having a lower male threaded portion 20*a* screwed into a female threaded portion 24*a* of the spring nut 24 so that drawing of the valve body 12 downwardly is accomplished by rotating the drive collar 20 relative to the valve body 12 while relative rotation between the valve body 12 and the spring nut 24 is prevented.

While we have described a preferred embodiment of the top mounted flush valve, it will be apparent to those skilled in the art that the invention may be modified in both arrangement and detail. For example, the fingers of the spring nut need not be resilient but may pivot similar to the retaining arms of a MOLLEY (Trademark) wall screw fastener. Therefore, the protection afforded the invention should only be limited in accordance with the scope of the following claims.

We claim:

1. A top mounted flush valve for installation in a blind drain hole in the bottom wall of a toilet tank, comprising:

a generally cylindrical valve body sized for insertion through a blind drain hole in a bottom wall of a toilet tank from the upperside thereof, the valve body having a central aperture;

means on an underside of the valve body for providing a watertight seal between the valve body and an upperside of the bottom wall of the tank;

a generally cylindrical drive collar rotatable within the central aperture of the valve body and having a first threaded portion; and a generally cylindrical spring nut having a second threaded portion engaged with the first threaded portion of the drive collar so that the drive collar can be screwed to generate relative movement between the drive collar and the spring nut along a longitudinal axis substantially perpendicular to the bottom wall of the tank, the spring nut having a plurality of fingers that can deflect inwardly to pass partially through the drain hole in the bottom wall of the tank during insertion and that can spring outwardly at a predetermined location of the spring nut relative to the bottom wall of the tank in order to provide a locking engagement between the spring nut and the bottom wall of the tank;

whereby rotation of the drive collar in a first predetermined direction relative to the spring nut will press the seal means on the underside of the valve body tightly against the upperside of the bottom wall of the tank, and rotation of the drive collar in a second predetermined direction opposite the first direction will release the seal means.

2. The flush valve of claim 1 wherein the seal means comprises a ring-shaped seal member made of an elastomeric material.

3. The flush valve of claim 2 wherein the underside of the valve body is formed with a circular groove for receiving and holding the seal member.

4. The flush valve according to claim 1 wherein the fingers of the spring nut are each formed with a pair of upper and lower, radially outwardly extending flanges for positioning adjacent the upperside of the bottom wall of the tank and an underside of the bottom wall of the tank, respectively.

5. The flush valve according to claim 4 wherein the lower flanges are formed with beveled shoulders to facilitate passage through the drain hole in the bottom wall of the tank.

6. The flush valve according to claim 1 wherein the valve body includes means for preventing rotation of the spring nut relative to the valve body while the drive collar is rotated in the first direction so that the valve body is pulled downwardly toward the bottom wall of the tank.

7. The flush valve according to claim 1 and further comprising a socket for receiving a lower end of an overflow tube.

8. The flush valve according to claim 7 and further comprising a pair of arms extending on opposite sides of the socket for receiving and holding a pair of arms of a flapper valve so that the flapper valve can pivot to open and close the central aperture in the valve body.

9. The flush valve according to claim 7 wherein the valve body is formed with a passage connecting the socket to the central aperture so that water entering an upper end of the overflow tube can flow through the drain hole while the flapper valve is in its closed position sealing the central aperture.

10. The flush valve according to claim 1 wherein the valve body is formed with a shoulder adjacent the central aperture that cooperates with a radially outwardly extending flange on the drive collar for preventing the drive collar from passing all the way through the central aperture.

11. The flush valve according to claim 1 wherein the valve body further includes a socket for receiving a lower end of an overflow tube, a passage connecting the socket to the central aperture and means for pivotally mounting the flapper valve.

12. The flush valve according to claim 1 wherein the valve body includes a radially extending flange having a groove on an underside thereof for receiving and holding the seal member, the flange of the valve body being slightly inclined relative to an upperside of the bottom wall moving in a radially outward direction.

13. A top mounted flush valve for a one-piece toilet having a blind drain hole in a bottom wall of a water tank, comprising:

a generally cylindrical valve body sized for insertion in the drain hole and including a valve seat for receiving a flapper valve for opening and closing a central aperture;

a seal member on an underside of the valve body for engaging an upperside of the bottom wall of the water tank;

a generally cylindrical drive collar concentrically mounted within the central aperture of the valve body and having a lower male threaded portion and an upper portion configured to prevent the drive collar from passing through the central aperture, the drive collar having means for permitting engagement thereof by a tool for rotation of the drive collar within the central aperture about a central axis of the valve body; and a spring nut having a lower female threaded portion screwed over the male threaded portion of the drive collar, a plurality of circumferentially spaced fingers having outer ends that can move radially inwardly to permit the spring nut to be partially inserted through the drain hole and move radially outwardly at a predetermined vertical location of the spring nut relative to the bottom wall to fix the position of the spring nut relative to the bottom wall, and the spring nut being configured so that it mates with the valve body to prevent rotation of the spring nut about the central axis of the valve body so that rotation of the drive collar in a predetermined direction about the central axis will pull the valve body and the seal member in a downward direction against the upperside of the bottom wall of the tank.

14. The flush valve of claim 13 wherein the fingers are resilient and deflect inwardly and then spring outwardly to fix the position of the spring nut relative to the bottom wall.

15. The flush valve of claim 13 wherein the valve body is formed with a shoulder and the drive collar is formed with a flange that engages the shoulder to prevent the drive collar from passing through the central aperture.

16. The flush valve of claim 13 wherein the drive collar has a plurality of circumferentially spaced openings in an annular wall which are shaped and sized to permit the fingers of the spring nut to deflect into the same.

17. The flush valve of claim 13 wherein the valve body is formed with a plurality of circumferentially spaced, downwardly extending annular wall sections, and the fingers of the spring nut are received between the annular wall sections when the spring nut mates with the valve body to prevent rotation of the spring nut relative to the valve body about the central axis of the valve body.

18. The flush valve of claim 13 wherein the fingers are formed with radially extending upper and lower flanges on the outer ends of the fingers that extend above the upperside of the bottom wall and below an underside of the bottom wall, respectively, when the spring nut is in the predetermined location relative to the bottom wall.

19. The flush valve of claim 13 wherein the lower flanges are beveled on a lower outer side thereof to facilitate passage of the lower flanges through the drain hole in the bottom wall.

20. A top mounted flush valve for a one-piece toilet having a blind drain hole in a bottom wall of a water tank, comprising:

a generally cylindrical valve body sized for insertion in the drain hole and including a valve seat for receiving a flapper valve for opening and closing a central aperture, a circumferentially extending shoulder surrounding the central aperture, a plurality of circumferentially spaced, downwardly extending annular wall sections, a socket for receiving a lower end of an overflow tube, a passage connecting the socket to the central aperture, and means for pivotally mounting the flapper valve;

a resilient deformable seal member on an underside of the valve body for engaging an upperside of the bottom wall of the water tank;

a generally cylindrical drive collar concentrically mounted within the central aperture of the valve body and having a lower male threaded portion and a circumferentially extending flange that engages the circumferentially shoulder on the valve body to prevent the drive collar from passing through the central aperture, the drive collar having means for permitting engagement thereof by a tool for rotation of the drive collar within the central aperture about a central axis of the valve body; and a spring nut having a lower female threaded portion screwed over the male threaded portion of the drive collar, a plurality of circumferentially spaced resilient fingers having outer ends that can deflect radially inwardly to permit the spring nut to be partially inserted through the drain hole and spring radially outwardly at a predetermined vertical location of the spring nut relative to the bottom wall to fix the position of the spring nut relative to the bottom wall, the fingers being formed with radially extending upper and lower flanges on the outer ends of the fingers that extend above the upperside of the bottom wall and below an underside of the bottom wall, respectively, when the spring nut is in the predetermined location relative to the bottom wall, and the spring nut being configured so that it mates with the valve body with the fingers of the spring nut being received between the annular wall sections of the valve body to prevent rotation of the spring nut relative to the valve body about the central axis of the valve body whereby rotation of the drive collar in a predetermined direction about the central axis will pull the valve body and the seal member in a downward direction against the upperside of the bottom wall of the tank.

* * * * *